US011819125B2

(12) United States Patent
Paulick

(10) Patent No.: US 11,819,125 B2
(45) Date of Patent: Nov. 21, 2023

(54) BOTTLE STORAGE DEVICE

(71) Applicant: Wine Master Cellars, LLC, Denver, CO (US)

(72) Inventor: John F. Paulick, San Luis Obispo, CA (US)

(73) Assignee: WINE MASTER CELLARS, LLC, Denver, CO (US)

( * ) Notice: Subject to any disclaimer, the term of this patent is extended or adjusted under 35 U.S.C. 154(b) by 0 days.

(21) Appl. No.: 17/985,026

(22) Filed: Nov. 10, 2022

(65) Prior Publication Data

US 2023/0072502 A1 Mar. 9, 2023

Related U.S. Application Data

(63) Continuation of application No. PCT/US2022/073112, filed on Jun. 23, 2022.

(60) Provisional application No. 63/213,802, filed on Jun. 23, 2021.

(51) Int. Cl.

| | |
|---|---|
| ***A47B 73/00*** | (2006.01) |
| ***A47F 7/00*** | (2006.01) |
| ***A47F 7/28*** | (2006.01) |

(52) U.S. Cl.

CPC ..... *A47B 73/006* (2013.01); *A47B 73/004* (2013.01); *A47F 7/0035* (2013.01); *A47F 7/283* (2013.01)

(58) Field of Classification Search

CPC .... A47B 73/004; A47B 73/006; B65D 71/50; A47F 7/283

See application file for complete search history.

(56) References Cited

U.S. PATENT DOCUMENTS

| | | | | | |
|---|---|---|---|---|---|
| 4,103,811 | A | * | 8/1978 | Owen | B65D 71/504 206/150 |
| D252,004 | S | * | 6/1979 | Leventhal | D7/706 |
| 4,569,440 | A | | 2/1986 | Steiger | |
| 4,795,038 | A | | 1/1989 | Johnson | |
| D329,781 | S | * | 9/1992 | Ito | D7/619.1 |
| 5,197,612 | A | * | 3/1993 | Thomson | F16B 12/10 211/74 |
| D350,039 | S | * | 8/1994 | Gener | D7/619.1 |
| D365,970 | S | * | 1/1996 | Kickinger | D6/682.2 |

(Continued)

FOREIGN PATENT DOCUMENTS

| | | | |
|---|---|---|---|
| JP | 2019154876 | A | 9/2019 |
| KR | 20090000087 | U | 1/2009 |

OTHER PUBLICATIONS

Page 8 of PCT/US22/73112 Written oppinion p. 237, dated Aug. 26, 2022 "Analyst Modified Figures 1-4 of Johnson" (U.S. Pat. No. 4,795,038) referred to in the Office Action dated Mar. 3, 2022 as "AMF" (Year: 2022).*

(Continued)

*Primary Examiner* — Ko H Chan

(74) *Attorney, Agent, or Firm* — Polsinelli PC

(57) ABSTRACT

A wine bottle holder including a plate and an extension member coupled to the plate. The extension member may extend outwards from the plate and a ring may be coupled to the extension member. The ring may be configured to receive a portion of the wine bottle. The ring may include a cylindrical body with opposite surfaces that are parallel to each other. The opposite surfaces may define oblique openings.

20 Claims, 47 Drawing Sheets

(56) References Cited

U.S. PATENT DOCUMENTS

| | | | | |
|---|---|---|---|---|
| D432,872 | S * | 10/2000 | Moore | D7/619.2 |
| 7,080,743 | B1 * | 7/2006 | Wolseth | A47B 73/004 211/74 |
| D548,535 | S * | 8/2007 | Schwallie | D7/619.1 |
| 7,441,668 | B2 * | 10/2008 | O'Malley | A47B 73/004 211/74 |
| 8,033,402 | B1 | 10/2011 | Bevis | |
| 10,506,878 | B2 * | 12/2019 | Sisto | A47F 7/285 |
| 2017/0172321 | A1 | 6/2017 | Toseki | |

OTHER PUBLICATIONS

Patent Cooperation Treaty, International Search Report and Written Opinion, International Application No. PCT/US2022/073112, dated Aug. 26, 2022, 11 pages.

* cited by examiner

BOTTLE STORAGE DEVICE

CROSS-REFERENCE TO RELATED APPLICATIONS

This application is a continuation of International Application No. PCT/US2022/073112, filed Jun. 23, 2022, which claims the benefit of U.S. Provisional Application No. 63/213,802, filed Jun. 23, 2021, which applications are incorporated herein by reference in their entireties for all purposes.

FIELD OF THE INVENTION

The present disclosure is directed to a bottle storage device for storing bottles or other similarly shaped objects. More specifically, the present disclosure is directed to a bottle holder that supports a wine bottle.

BACKGROUND OF THE INVENTION

Conventionally, wine racks are used in wine cellars or other wine storage areas to store numerous bottles of wine in a desired area. With conventional wine racks, the bottles of wine are supported along the length of the bottle within a grid of generally rectangular cavities stacked upon and next to each other, each rectangular cavity typically formed by pairs of parallel wood supports held in position by front and rear frame structures. In this example of a conventional wine rack, the wine rack is typically configured such that user places a bottle of wine lengthwise within one of the rectangular cavities such that when the rack is full of wine bottles, only the top ends (i.e., where the foil is wrapped around the top end) of the wine bottles are generally visible when viewing the wine rack. In this arrangement, the labels on the wine bottle are not generally visible by the user. As such, in order to determine which type of wine (e.g., varietal/grape type, winery name, vintage/year, etc.) is stored in a particular cavity of such a wine rack, the user may need to remove the bottle from the wine rack in order to view the label on the bottle.

As such, there is a need in the art for wine racks that provides storage for wine bottles while permitting the user to view the label of the bottle of wine as the wine bottle rests in the wine rack.

SUMMARY

Aspects of the present disclosure include a wine bottle holder. The wine bottle holder may include: a plate, an extension member, and a first ring. The plate may be configured to be mounted to a surface. The extension member may be coupled to the plate and extend outwards from the plate. The first ring may be coupled to the extension member. The first ring may be configured to receive a portion of a first wine bottle. The first ring may include a first oblique cylindrical body that has a first pair of opposite end surfaces that are parallel to each other. The first pair of opposite end surfaces may define first oblique openings.

In certain instances, the first oblique cylindrical body may include a first outer cylindrical surface and a first inner cylindrical surface.

In certain instances, the first oblique cylindrical body may include a first inner cylindrical surface and a first centerline that is coaxial with the first inner cylindrical surface. The first oblique cylindrical body may be oriented so that the first centerline forms an angle between 15-degrees and 75-degrees with respect to a vertical axis when the plate is mounted to the surface.

In certain instances, the first inner cylindrical surface of the first ring may be configured to receive a neck of the first wine bottle, the first wine bottle angled in a cork-down orientation.

In certain instances, the extension member may be substantially perpendicular to the plate.

In certain instances, the plate may include at least one through hole configured to receive a fastener to mount the plate to the surface.

In certain instances, the plate, the extension member, and the first ring may be unitarily constructed.

In certain instances, the first oblique cylindrical body may include a first inner cylindrical surface and a first centerline that is coaxial with the first inner cylindrical surface. One of the first pair of opposite end surfaces of the first oblique cylindrical body may lie in a plane having a normal line centered on the first oblique opening, the first centerline not being coincident with the normal line.

In certain instances, the plate may be configured to be mounted in a first configuration and a second configuration by rotating the plate one hundred eighty degrees on the surface. In both the first configuration and the second configuration, a wine bottle is configured to be supported in a same angular orientation relative to a vertical axis.

In certain instances, the wine bottle holder further may include a second ring coupled to the first ring. The second ring may be configured to receive a portion of a second wine bottle. The second ring may include a second oblique cylindrical body that has a second pair of opposite end surfaces that are parallel to each other. The second pair of opposite end surfaces may define second oblique openings.

In certain instances, the second oblique cylindrical body may include an inner cylindrical surface and a second centerline that is coaxial with the inner cylindrical surface. The second oblique cylindrical body may be oriented so that the second centerline forms an angle between 15-degrees and 75-degrees with respect to a vertical axis when the plate is mounted to the surface. The second ring may be in an opposite orientation with respect to the vertical axis from the first ring so as to orient the first and second wine bottles in an opposing orientation.

Aspects of the present disclosure include a wine bottle holder. The wine bottle holder may include: a plate, a first extension member, a first ring, a second extension member, and a second ring. The plate may be configured to be mounted to a surface. The first extension member may be coupled to the plate and extend outwards from the plate. The first ring may be coupled to the first extension member. The first ring may be configured to receive a portion of a first wine bottle. The first ring may include a first oblique cylindrical body that has a first pair of opposite end surfaces that are parallel to each other. The first pair of opposite end surfaces may define first oblique openings. The second extension member may be coupled to the plate, spaced apart from the first extension member, and extend outwards from the plate. The second ring may be coupled to the second extension member. The second ring may be configured to receive a portion of a second wine bottle. The second ring may include a second oblique cylindrical body that has a second pair of opposite end surfaces that are parallel to each other. The second pair of opposite end surfaces may define second oblique openings.

In certain instances, the first oblique cylindrical body may include a first outer cylindrical surface and a first inner cylindrical surface. The second oblique cylindrical body may include a second outer cylindrical surface and a second inner cylindrical surface.

In certain instances, the first oblique cylindrical body may define a first centerline that is coaxial with the first inner cylindrical surface. The second oblique cylindrical body may define a second centerline that is coaxial with the second inner cylindrical surface. The first oblique cylindrical body may be oriented so that the first centerline forms an angle between 15-degrees and 75-degrees with respect to a vertical axis when the plate is mounted to the surface. The second oblique cylindrical body may be oriented so that the second centerline forms an angle between 15-degrees and 75-degrees with respect to the vertical axis when the plate is mounted to the surface.

In certain instances, the inner cylindrical surface of the first ring may be configured to receive a neck of the first wine bottle, the first wine bottle angled in a cork-down orientation. The inner cylindrical surface of the second ring may be configured to receive the neck of the second wine bottle, the second wine bottle angled in a cork-down orientation.

In certain instances, the first extension member may be substantially perpendicular to the plate. The second extension member may be substantially perpendicular to the plate.

In certain instances, the plate may include at least one through hole configured to receive a fastener to mount the plate to the surface.

In certain instances, the plate, the first extension member, the first ring, the second extension member, and the second ring may be unitarily constructed.

In certain instances, the wine bottle holder further may include a third ring and a fourth ring. The third ring may be coupled to the first ring and configured to receive a portion of a third wine bottle. The third ring may include a third oblique cylindrical body having a third pair of opposite end surfaces that are parallel to each other. The third pair of opposite end surfaces may define third oblique openings. The fourth ring may be coupled to the second ring and configured to receive a portion of a fourth wine bottle. The fourth ring may include a fourth oblique cylindrical body having a fourth pair of opposite end surfaces that are parallel to each other. The fourth pair of opposite end surfaces may define fourth oblique openings.

In certain instances, the third ring may be positioned a distance away from the plate and the fourth ring may be positioned that distance away from the plate.

BRIEF DESCRIPTION OF THE DRAWINGS

The present invention will become more fully understood from the detailed description and the accompanying drawings, wherein.

DETAILED DESCRIPTION

Figure 1:
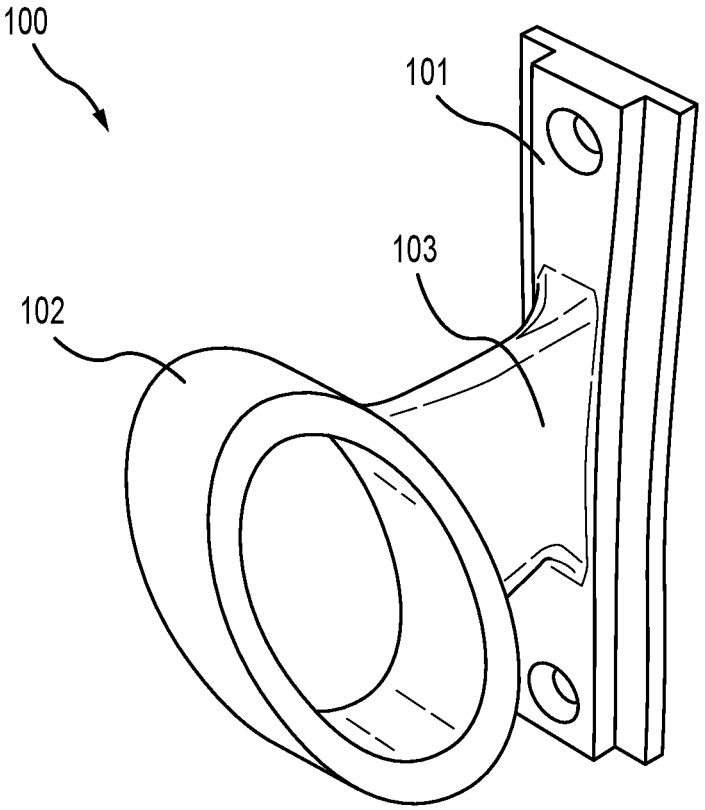
FIG. 1 is a perspective view of a wall-mountable bottle holder in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

A ring consisting of an oblique cylindrical body may provide greater contact area than a right cylindrical body. The increased contact area may reduce stress concentrations on the bottle, thereby providing a safer way to support a bottle.

Figure 2:
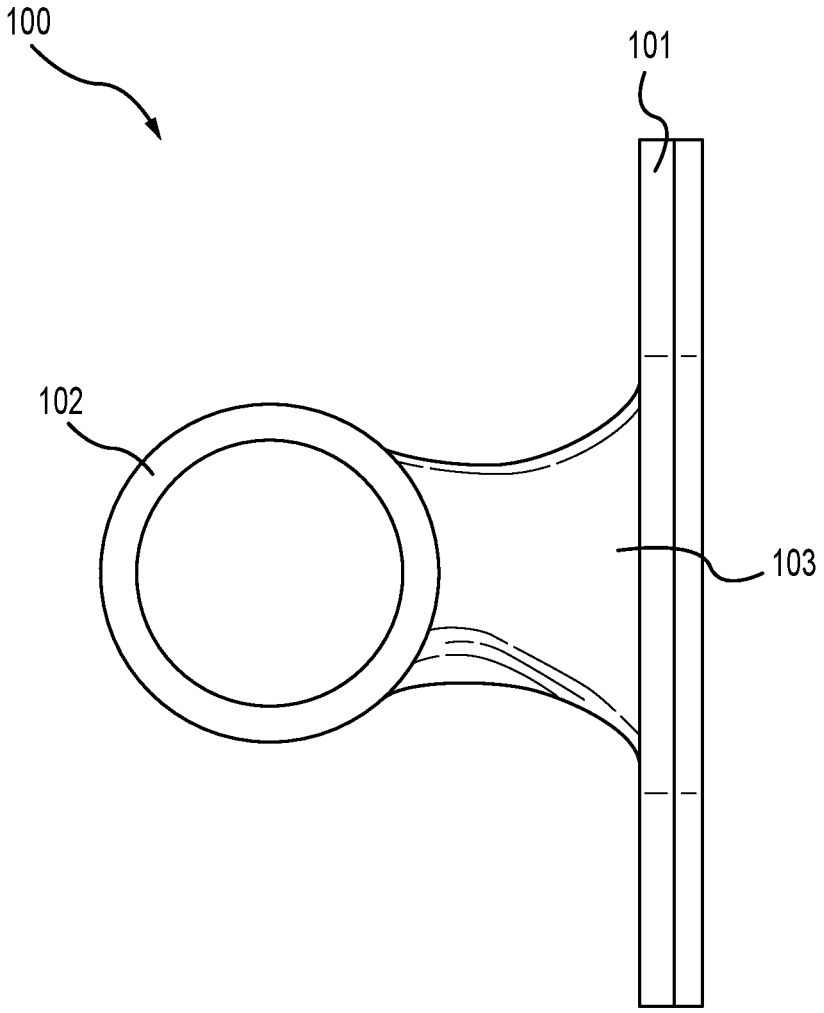
FIG. 2 is a side view of the wall-mountable bottle holder of FIG. 1.
Figure 3:
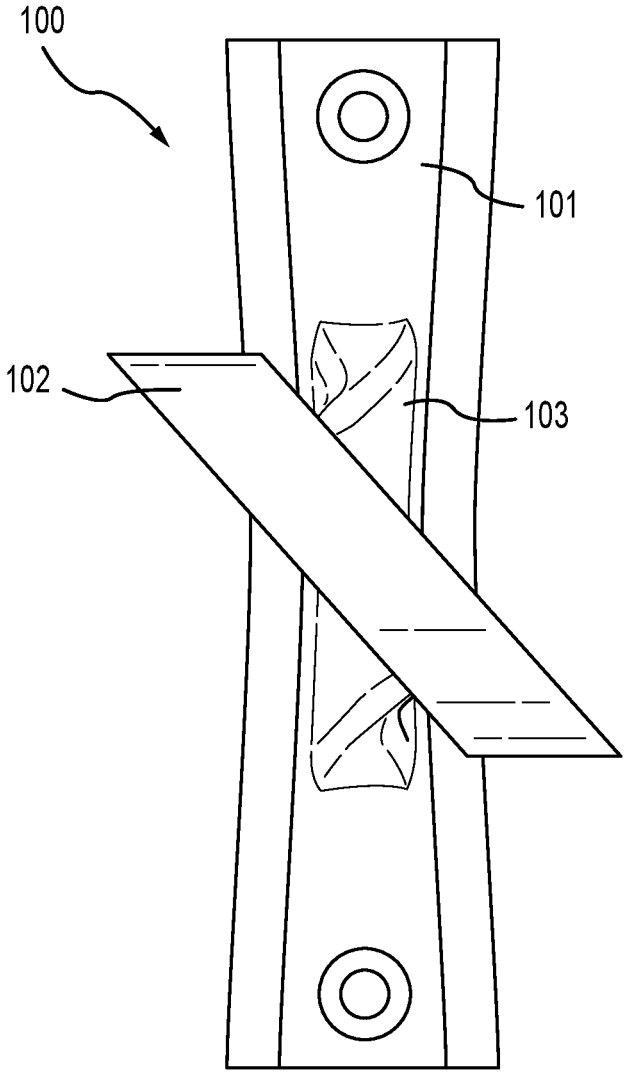
FIG. 3 is a front view of the wall-mountable bottle holder of FIG. 1.
Figure 11:
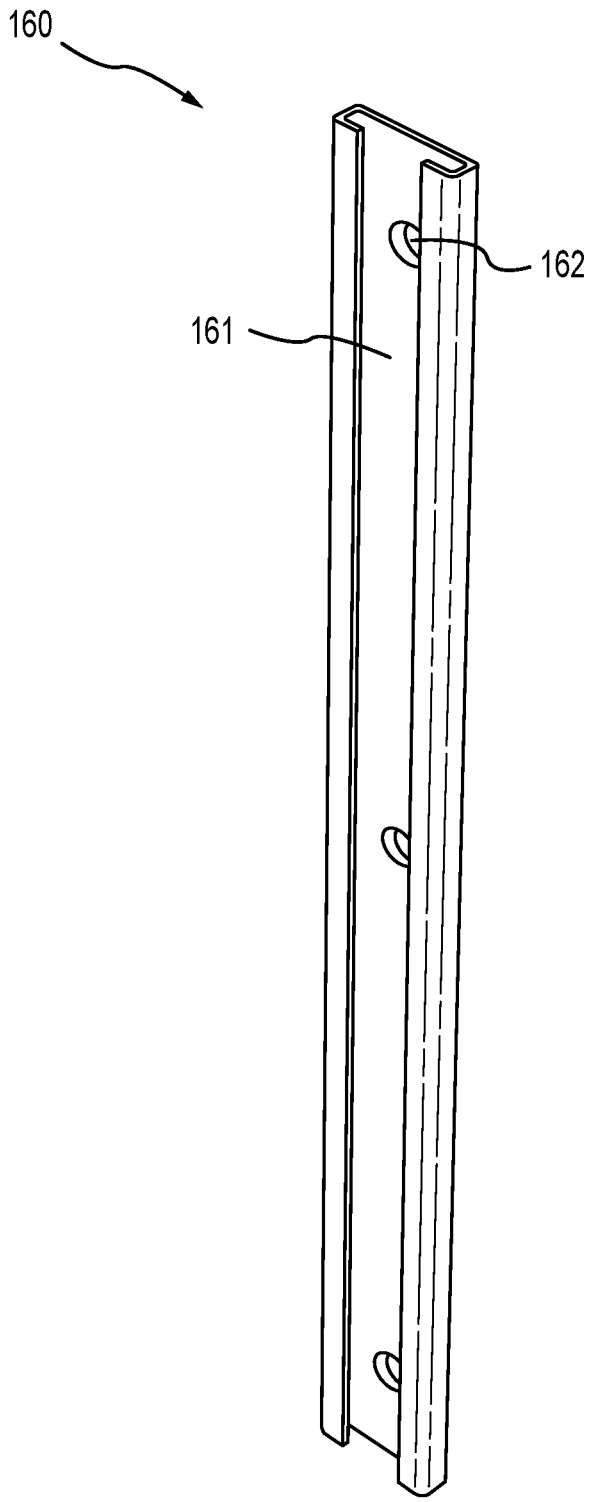
FIG. 11 is a perspective view of the mounting bracket of FIGS. 8 and 9.

FIGS. 1-3 illustrate a wall-mountable bottle holder 100 (hereinafter "bottle holder") in accordance with an embodiment of the present invention. The bottle holder 100 includes a mounting portion or plate 101 configured to be mounted to the wall and a holding portion or ring 102 configured to hold a bottle, such as a bottle of wine or the like. The plate portion 101 may be coupled directly to a wall using the provided holes by inserting screws or the like therethrough and into the wall. Alternatively, the plate portion 101 may be slidably coupled to a mounting bracket (see, for example, FIG. 11), which is in turn coupled directly to the wall.

Figure 4:
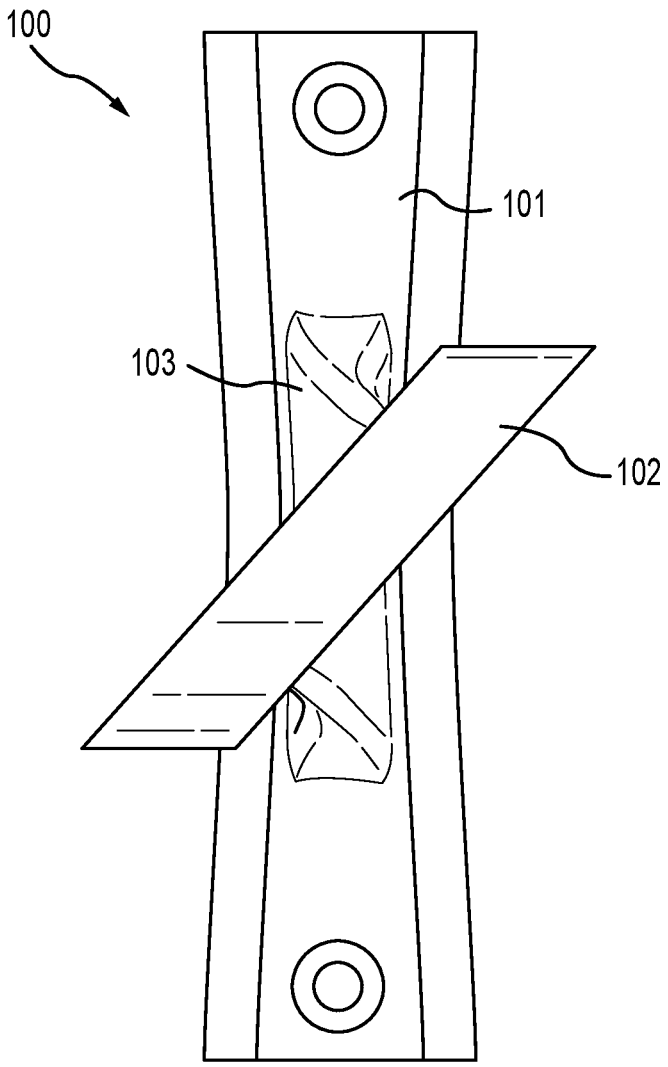
FIG. 4 is a front view of a wall-mountable bottle holder that is a slightly modified version of the wall-mountable bottle holder of FIG. 1.

A wall member or extension member 103 protrudes from the plate portion 101 to connect the holder portion 102 to the plate portion 101. Thus, the holder portion 102 is spaced apart from the wall member 103 by a distance equal to a length of the wall member 103. The holder portion or ring 102 is an annular shaped member having an inner surface that defines a through-hole configured to receive a neck of a bottle. Furthermore, the holder portion 102 is oriented at an oblique angle relative to the plate portion 101 to enable the holder portion 102 to successfully hold a bottle by the neck of the bottle. FIG. 3 illustrates the holder portion 102 oriented in one direction and FIG. 4 illustrates the holder portion 102 oriented in the opposite direction. In FIG. 3 a bottle will extend from the holder portion 102 horizontally to the right, and in FIG. 4 a bottle will extend from the holder portion 102 horizontally to the left. Otherwise, the bottle holder 100 in FIG. 4 is identical to the one in FIG. 3.

Figure 5:
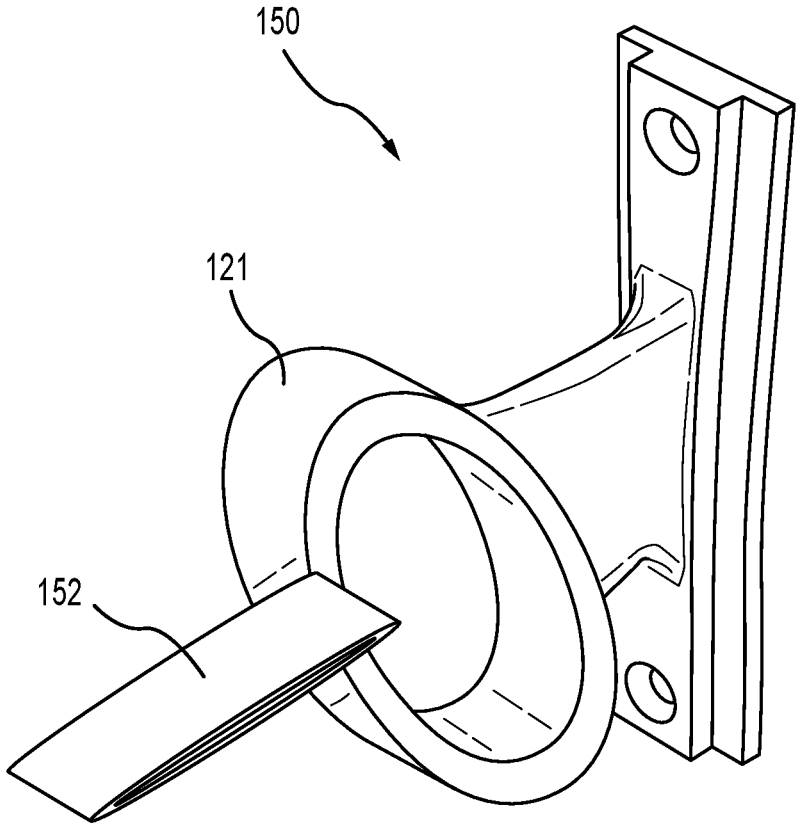
FIG. 5 is a perspective view of a wall-mountable dual bottle holder in accordance with an embodiment of the present invention.
Figure 6:
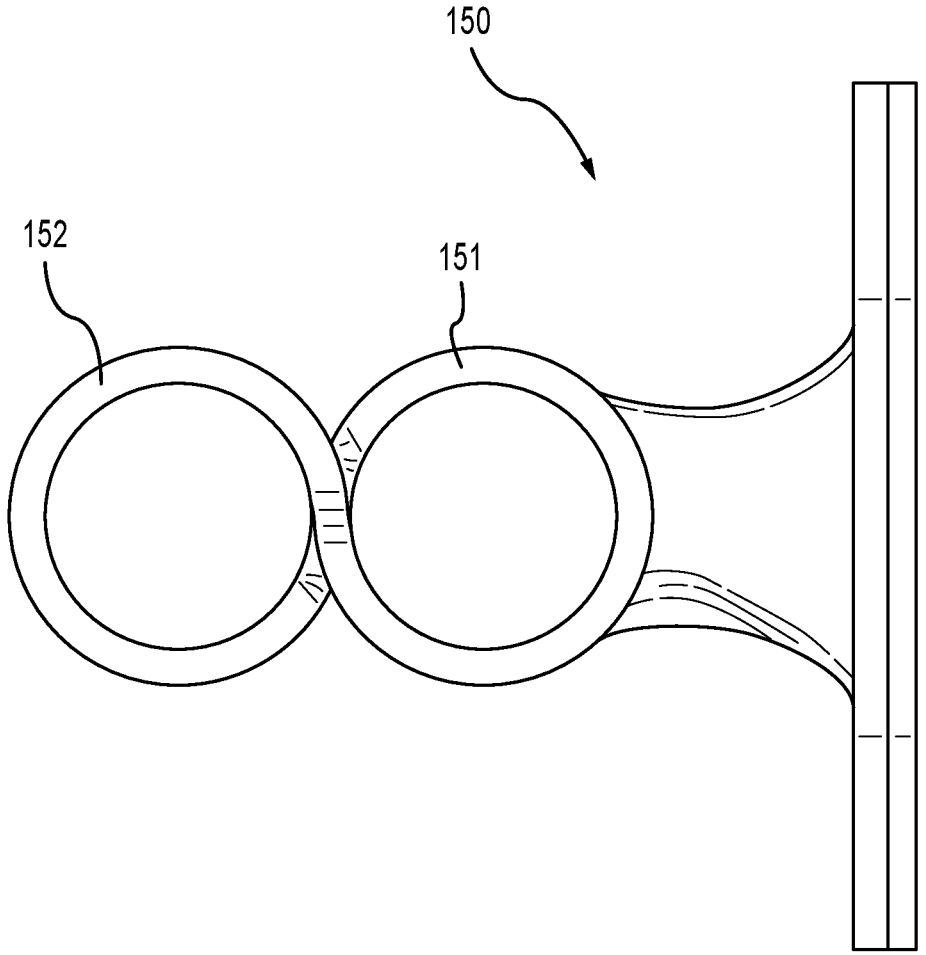
FIG. 6 is a side view of the wall-mountable dual bottle holder of FIG. 5.
Figure 7:
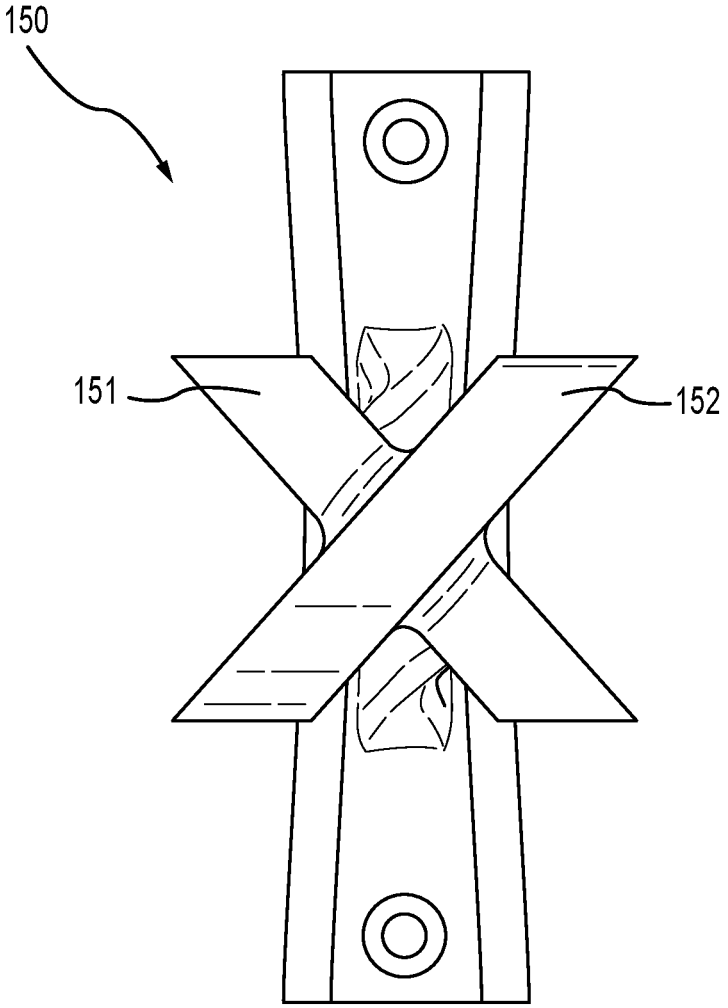
FIG. 7 is a front view of the wall-mountable dual bottle holder of FIG. 5.

FIGS. 5-7 illustrate a wall-mountable dual bottle holder 150. The wall-mountable dual bottle holder 150 is identical to the bottle holder 100 except that it includes a first holder portion 151 and a second holder portion 152 that are positioned in opposite oblique orientations. Thus, when viewed from the front as shown in FIG. 7, the two holder portions 151, 152 form an "X" shape. The dual bottle holder 150 can thereby hold one bottle to extend leftward and another bottle to extend rightward.

Figure 8:
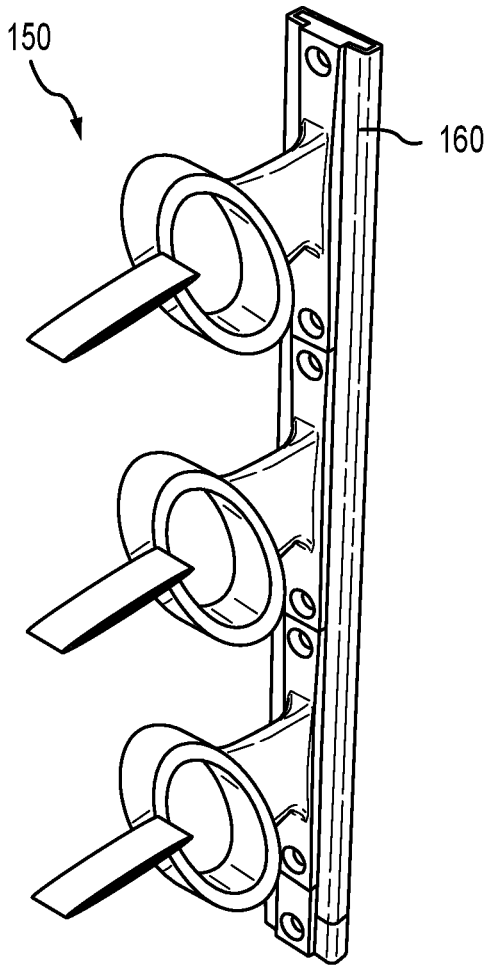
FIGS. 8 and 9 are, respectively, perspective and front views of multiple of the wall-mountable dual bottle holders of FIG. 5 coupled to a singular mounting bracket that is configured to be mounted on a wall.
Figure 9:
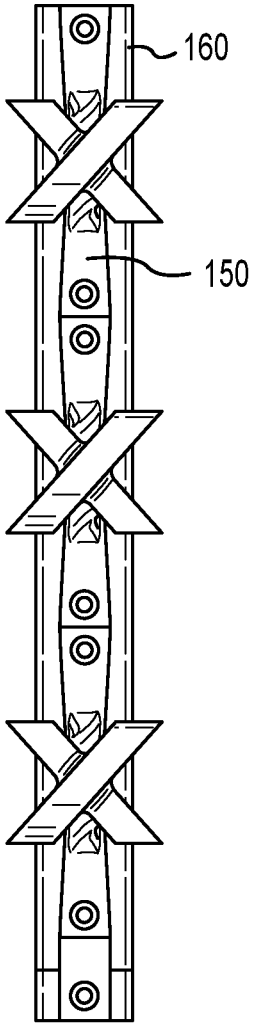
Figure 10:
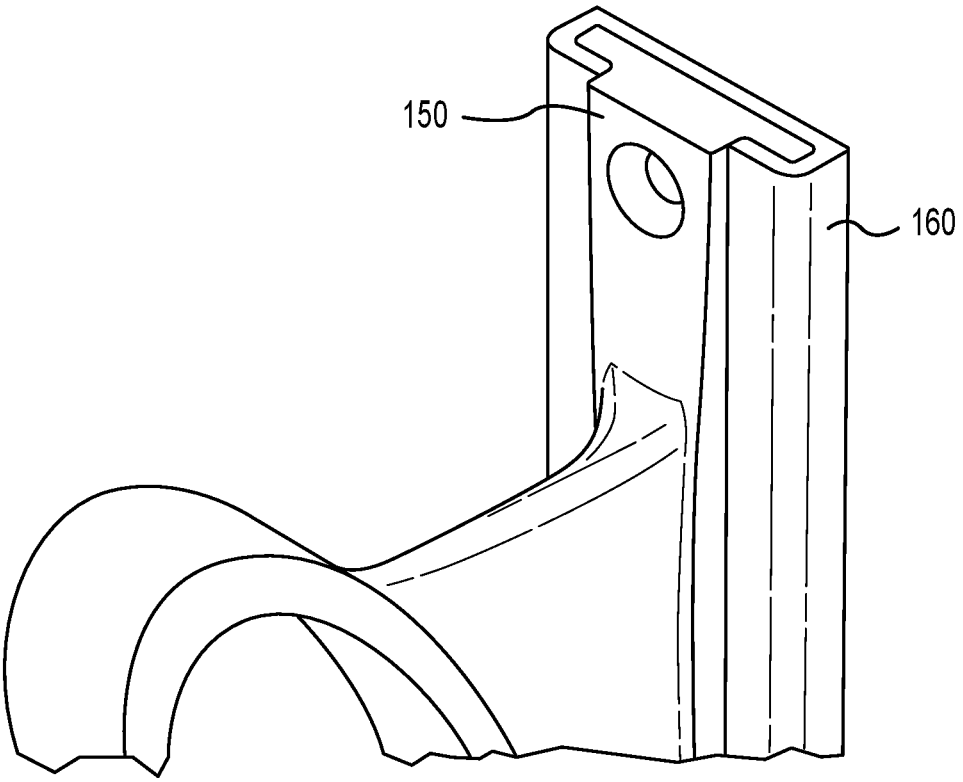
FIG. 10 is a close-up perspective view of a portion of FIG. 8 to illustrate the engagement between the wall-mountable dual bottle holder and the mounting bracket.

FIGS. 8 and 9 illustrate a plurality of the dual bottle holders 150 arranged adjacently and received within a mounting bracket 160. The mounting bracket 160 is shown by itself in FIG. 11. The mounting bracket 160 includes a channel 161 having a floor and a plurality of mounting holes 162 extending through the floor. Thus, the mounting bracket 160 is configured to be mounted directly to a wall by inserting screw through the mounting holes 162 and into the wall. Next, a set of the bottle holders 100, 150 described herein can be slidably inserted into the channel 161. The screw may be inserted through the openings in the bottle holders 100, 150 and into the holes 162 in the mounting bracket 160 to simultaneously attach the bottle holders 100, 150 to the mounting bracket 160 and attach the apparatus to the wall. Alternatively, set screws can be used to secure the bottle holders to the mounting bracket 160 with the mounting bracket 160 mounted directly to the wall as noted above. FIG. 10 is a close-up view illustrating the interaction between the plate portion of the dual bottle holders 150 and the channel 161 of the mounting bracket 160.

Figure 12:
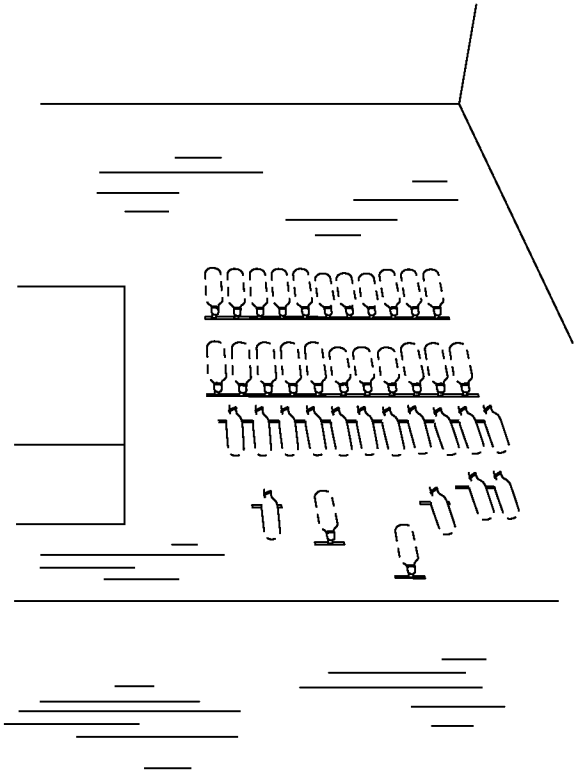
FIGS. 12 and 13 are perspective views of the wall-mountable bottle holders of FIGS. 1 and 4 mounted to a wall and supporting bottles.
Figure 13:
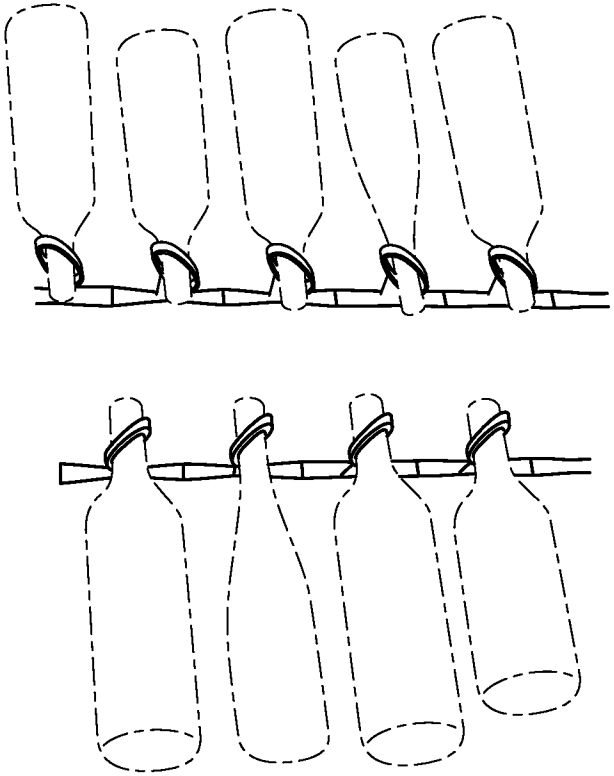
Figure 14:
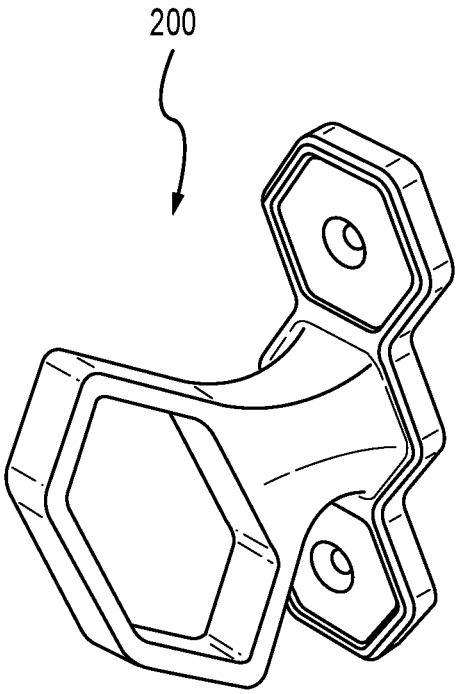
FIG. 14 is a perspective view of a wall-mountable bottle holder in accordance with still another embodiment of the present invention.
Figure 15:
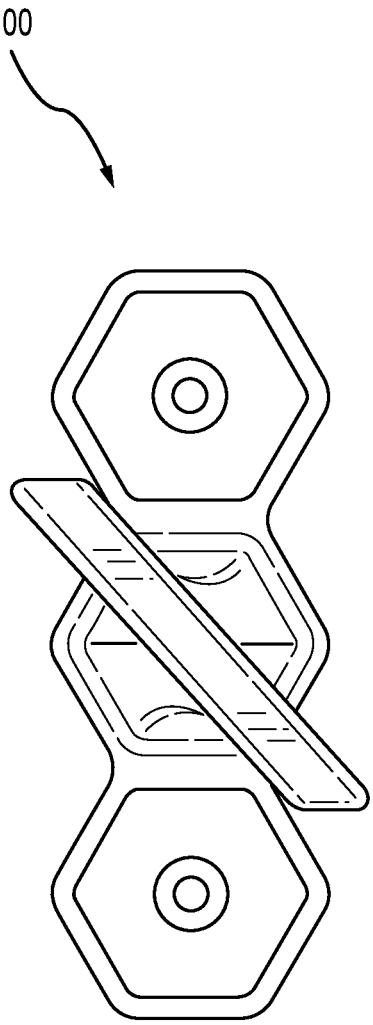
FIG. 15 is a front view of the wall-mountable bottle holder of FIG. 14.
Figure 16:
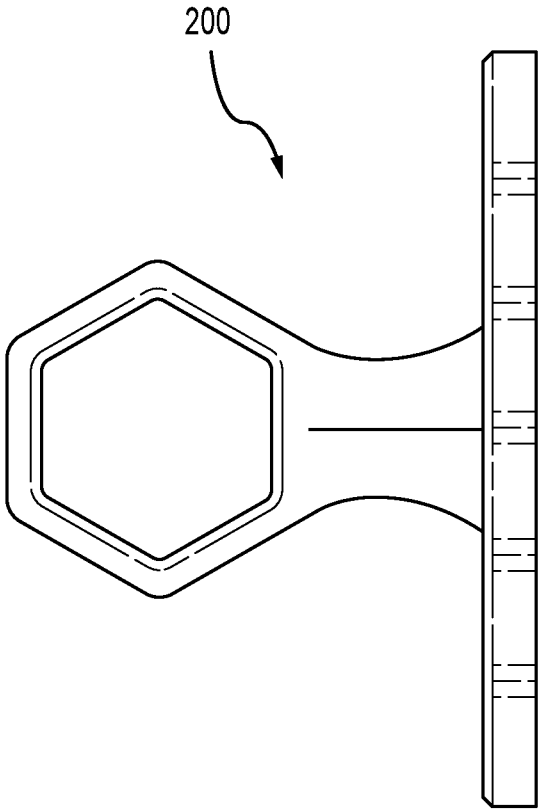
FIG. 16 is a side view of the wall-mountable bottle holder of FIG. 14.
Figure 17:
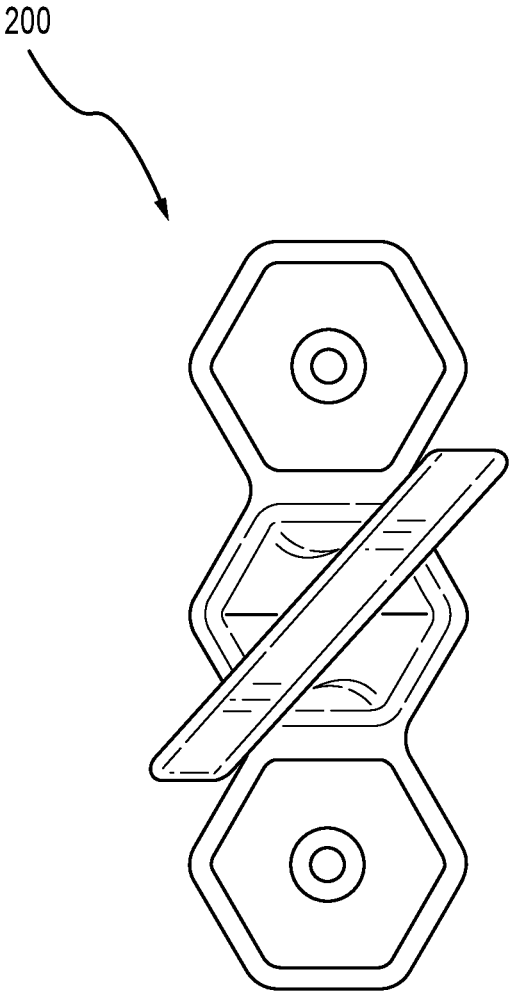
FIG. 17 is a front view of a slightly modified version of the wall-mountable bottle holder of FIG. 14 intended for supporting bottles horizontally in the opposite direction.
Figure 18:
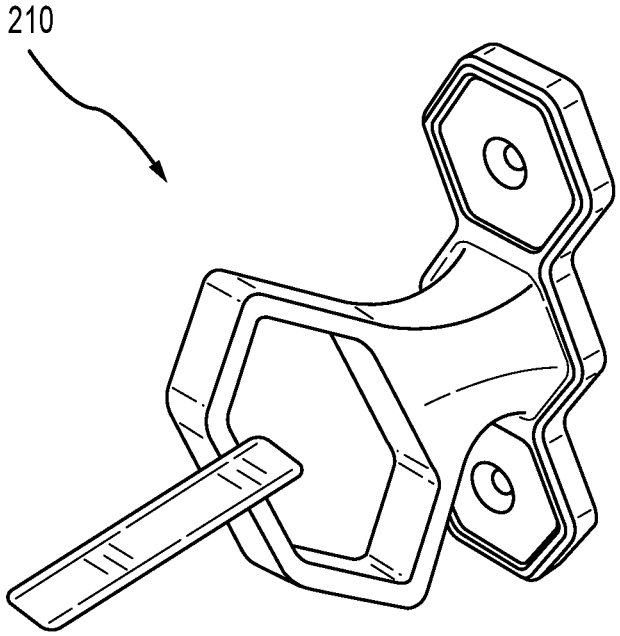
FIG. 18 is a perspective view of a wall-mountable dual bottle holder in accordance with another embodiment of the present invention.
Figure 19:
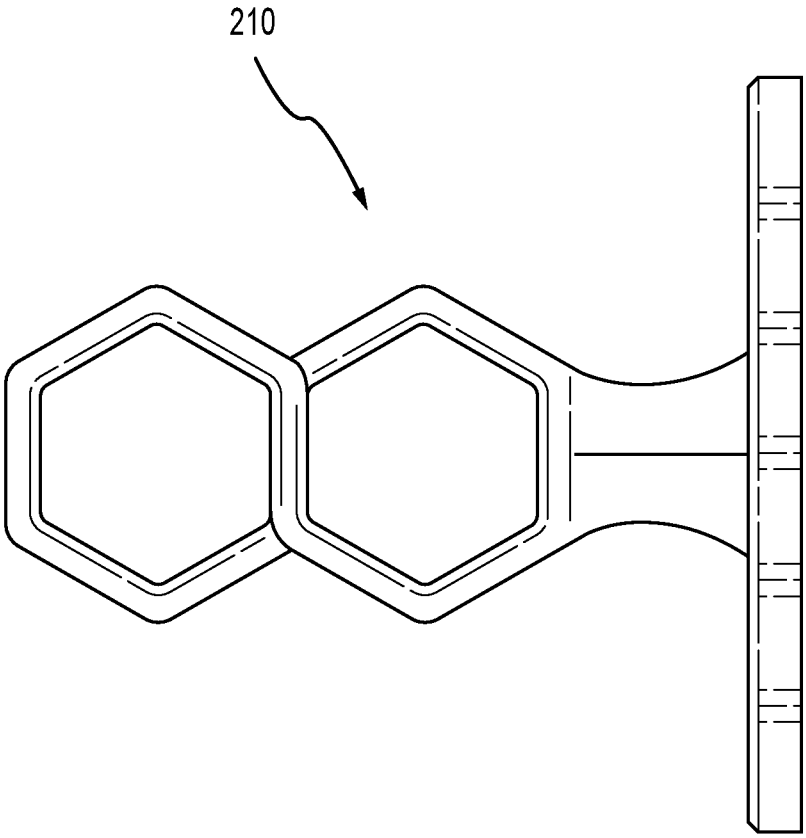
FIG. 19 is a side view of the wall-mountable dual bottle holder of FIG. 18.
Figure 20:
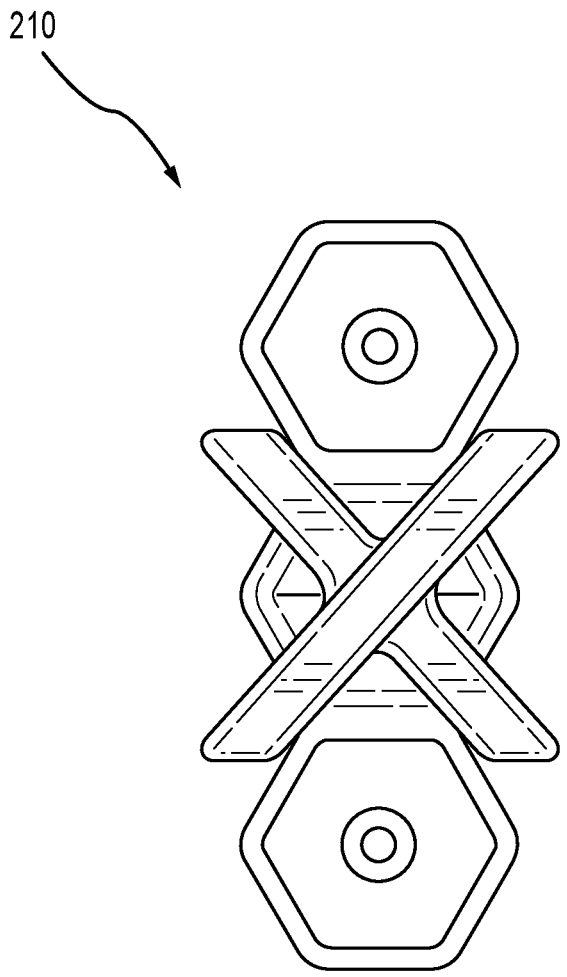
FIG. 20 is a front view of the wall-mountable dual bottle holder of FIG. 18.
Figure 21:
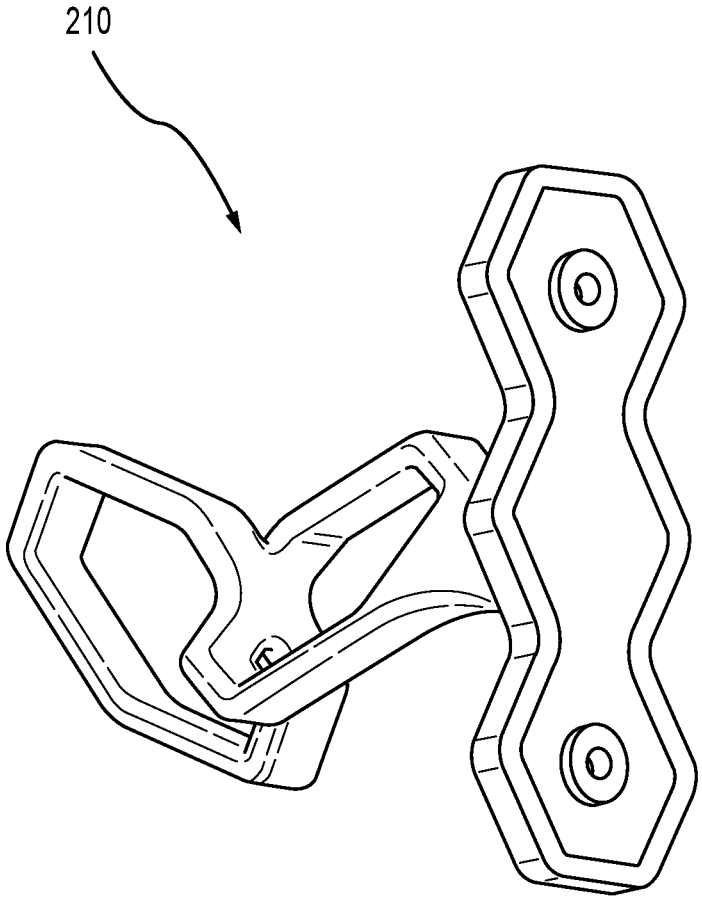
FIG. 21 is a rear view of the wall-mountable dual bottle holder of FIG. 18.

FIGS. 12 and 13 illustrate the various bottle holders described herein above mounted to a wall and being used to support bottles, and specifically wine bottles in the exemplified embodiment. However, other bottles could be supported by the bottle holders, including liquor or any other type of beverage bottle, or the like. As seen in the figures, the labels on the bottles are visible because the bottles are oriented generally parallel to the wall.

FIGS. 14-17 illustrate yet another embodiment of a bottle holder 200. This bottle holder 200 is very similar to the ones described above, except that the holder portions are hexagonal instead of circular and the plate portion has hexagonal shaped mounting portions. FIGS. 18-21 illustrate a bottle holder 200 that is the same as the bottle holder 200, except it has two holder portions for holding two bottles (i.e., like the dual bottle holder 150 described above). As seen, the mounting portions have through-holes to facilitate the attachment of the bottle holders 200, 210 to the wall as described herein.

Figure 22:
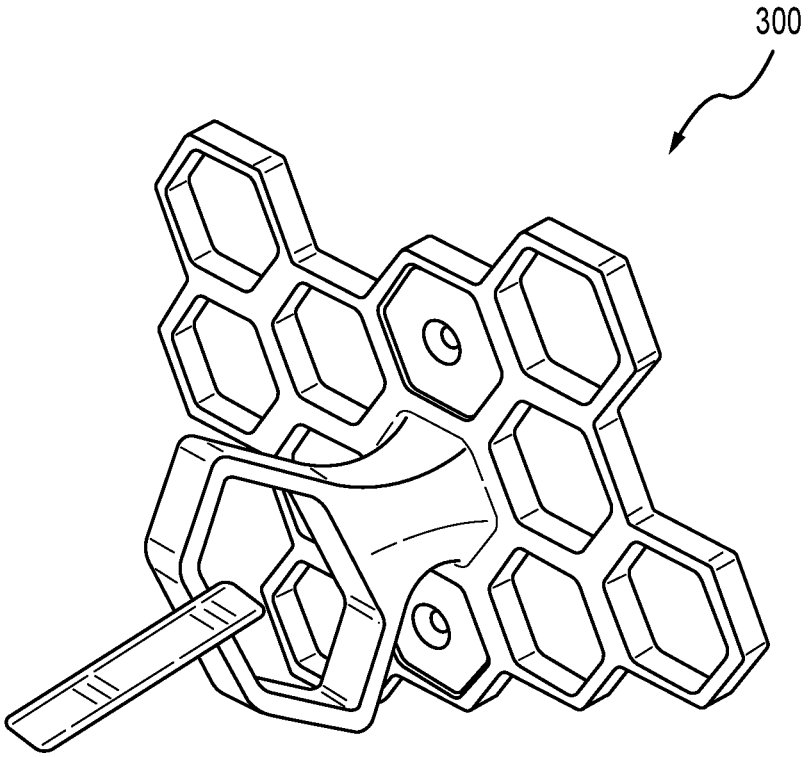
FIG. 22 is a perspective view of a wall-mountable bottle holder with a latticed mounting portion in accordance with yet another embodiment of the present invention.
Figure 23:
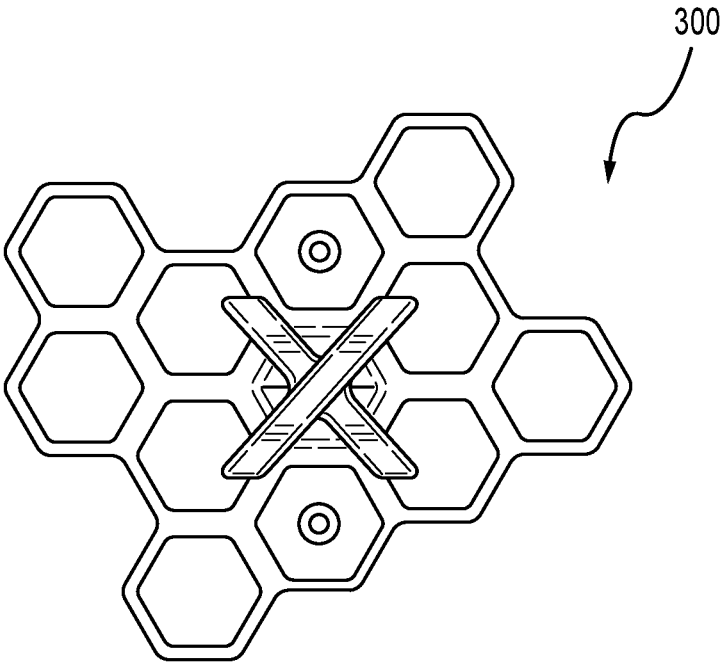
FIG. 23 is a front view of the wall-mountable bottle holder of FIG. 22.
Figure 24:
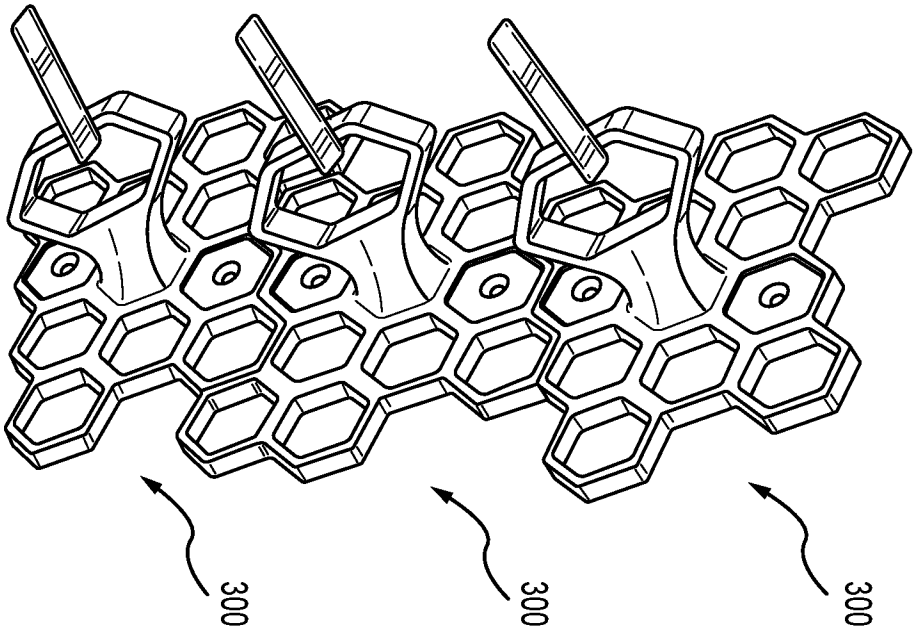
FIG. 24 is a bottle rack formed by arranging multiple of the wall-mountable bottle holders of FIG. 22 in a stacked and mating configuration.

FIGS. 22 and 23 is another example of a bottle holder 300 that is similar to the ones described above, except it includes additional hollowed-out hexagonal mounting features. As shown in FIG. 24, a plurality of the bottle holders 300 may be arranged in a side-by-side manner to create a unique visual appearance with the hexagonal mounting features.

Figure 25:
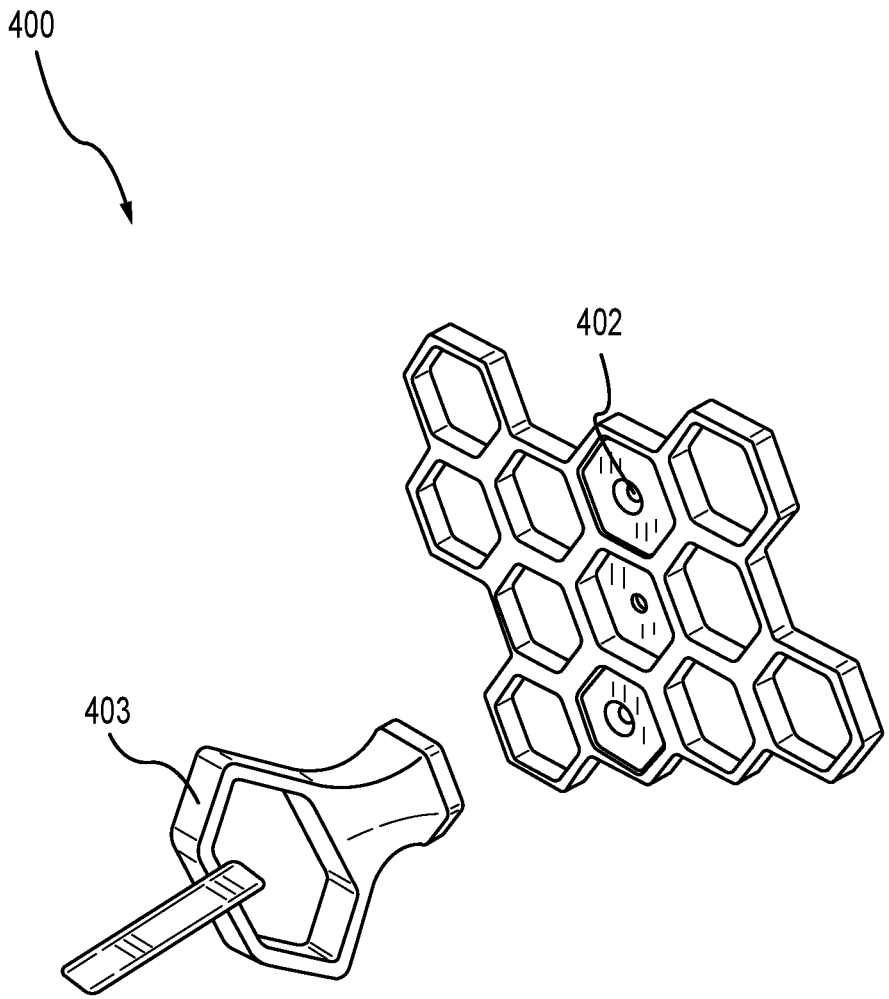
FIG. 25 is a perspective view of a two-component wall-mountable bottle holder with the latticed mounting portion in accordance with an embodiment of the present invention.

FIG. 25 is a two-component bottle holder system 400. In this system, the bottle holder portion 401 is separate from the wall mount portion 402. The bottle holder portion 401 may be configured for attachment to the wall mount portion 402 via fasteners or other hardware such as screws, nails, bolts, set screws, or the like. The wall mount portion 402 can be mounted to the wall using the mounting holes as has been described above with the prior embodiments. The two-component bottle holder system 400 is identical to the bottle holder 300 except it comes in two parts for ease of manufacturing.

The bottle holder may be formed from any material desired, including aluminum or other metals, plastic, thermoplastic, cork, or the like. The holder portion of the bottle holder may have any desired diameter. Thus, if the bottle holder is configured to store a standard Bordeaux wine bottle, the holder portion may have a sufficient diameter for this purpose. The bottle holder may be mounted to the wall using screws, anchors, and/or other hardware through the mounting holes.

FIGS. 26A-H illustrate one instance of a bottle holder 500. The bottle holder 500 includes a plate 501, an extension member 503 extending from the plate 501, and a ring 502 coupled to the extension member 503. Due to the orientation of the ring 502 in FIGS. 26A-H, the body of the bottle extends from the ring 502 upwardly and to the left of the ring 502 and a portion of the neck of the bottle extends from the ring 502 downwardly and to the right of the ring 502. This is a cork-down orientation.

The bottle holder 500 may be made from plastic, wood, or metal, among other materials. As non-limiting examples of metals, the bottle holder 500 may be constructed of aluminum, brass, copper, steel, titanium, or a combination thereof. In one instance, the plate 501, the extension member 503, and the ring 502 may be unitarily constructed. For example, the bottle holder 500 may be constructed entirely of steel. In other instances, the bottle holder 500 may be constructed of more than one material.

In one instance, the plate 501 may be generally rectangular in shape. In other instances, the plate 501 may be generally circle shaped, oval shaped, triangle shaped, square shaped, rhombus shaped, trapezoid shaped, pentagon shaped, hexagon shaped, heptagon shaped, or octagon shaped.

The plate 501 may include a first end 505 and a second end 507, wherein the second end 507 is opposite the first end 505. In one instance, when the bottle holder 500 is installed, the first end 505 may be the top end of the plate 501 and the second end 507 may be the bottom end of the plate 501.

The plate 501 may include a rear-facing surface 509 (seen in FIG. 26C) and a front-facing surface 511. In one instance, when the bottle holder 500 is installed, the rear-facing surface 509 may be the wall-facing surface of the plate 501 and the front-facing surface 511 may be the room-facing surface of the plate 501. The distance between the rear-facing surface 509 and the front-facing surface 511 defines a thickness of the plate 501.

The plate 501 may include a first side edge 513 and a second side edge 515, wherein the second side edge 515 is opposite the first side edge 513. In one instance, when the bottle holder 500 is installed, the first side edge 513 may be the left-side edge of the plate 501 and the second side edge 515 may be the right-side edge of the plate 501. In one instance, the plate 501 may include in-cuts at the first side edge 513 and/or second side edge 515, thereby defining a waist of the plate 501.

The plate 501 may be configured to be mounted to a surface. In one instance, the surface may be a substantially vertical surface such as a wall. The plate 501 may contain an adhesive on the rear-facing surface, whereby the adhesive is configured to mount the plate 501 to a surface.

The plate 501 may include one or more through-holes 517 that are each configured to each receive a fastener to mount the plate 501 to the surface. As non-limiting examples, fasteners may include nails, screws, or bolts. Additional hardware, such as anchors, may be used to mount the plate 501 to the surface. In one instance, a fastener may be inserted through a through-hole 517 to attach the plate 501 to a wall, thereby mounting the bottle holder 500 to the wall. In one instance, the plate 501 may include two through-holes 517. A first through-hole 517 may be located near the first end 505 of the plate 501 and a second through-hole 517 may be located near the second end 507 of the plate 501. In another instance, the plate 501 may include one through-hole 517. In other instances, the plate 501 may include three, four, five, six, seven, or eight through-holes 517.

Figure 26A:
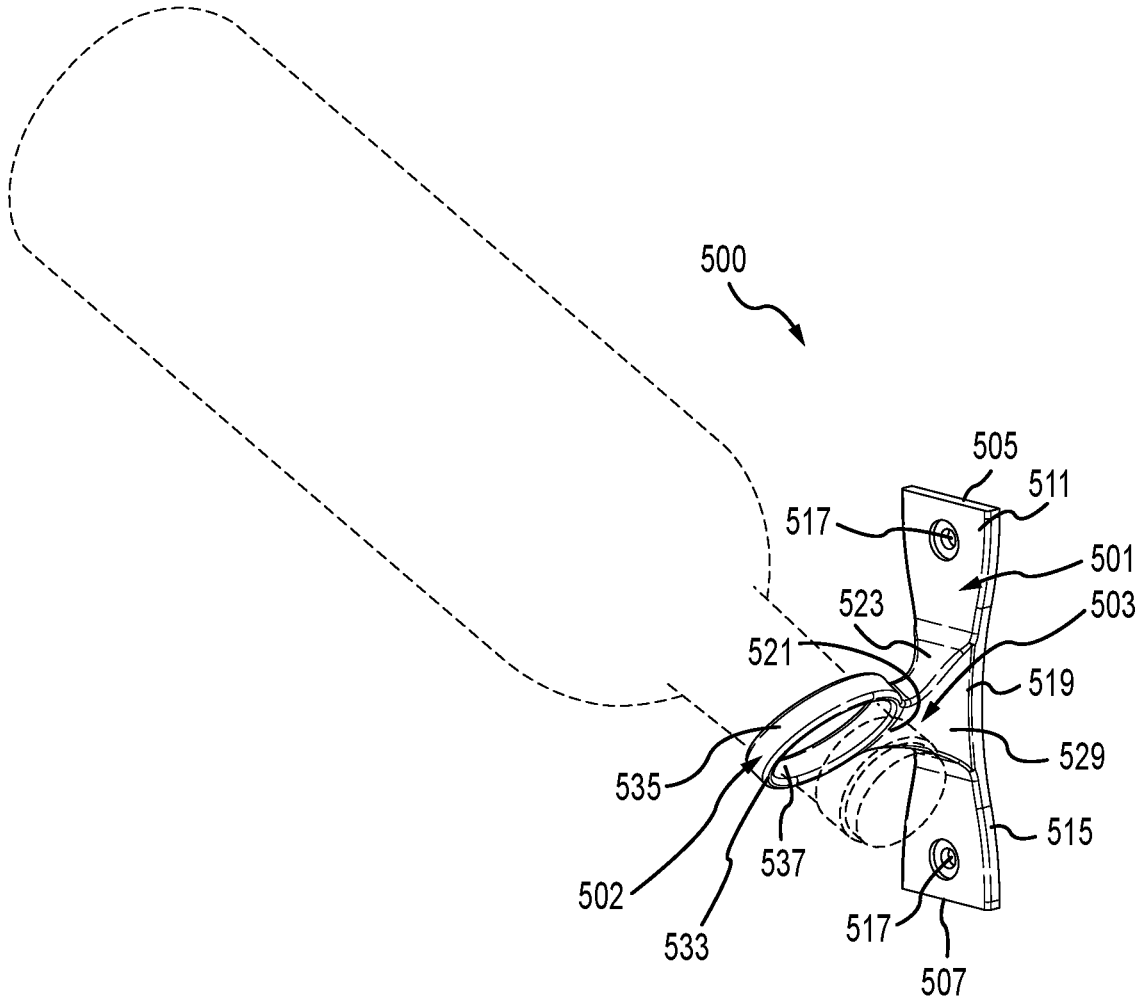
FIG. 26A is a perspective view of one instance of a wall-mountable bottle holder with a bottle in broken lines being supported by the holder.

The plate 501 may be configured to be mounted in a first configuration and a second configuration. The second configuration may include rotating the plate 180-degrees from the first configuration. The bottle holder 500 may be configured so that a bottle will be supported in the same orientation relative to a vertical axis in both the first configuration and the second configuration. That is, the bottle holder can be mounted with either the first end 505 at the top and the second end 507 at the bottom or vice versa with the second end 507 at the top and the first end 505 at the bottom. In both orientations, the body of the bottle supported by the ring 502 will extend upward to the left and the cork will be down and to the right, as seen in FIG. 26A.

Continuing with FIGS. 26A-H, an extension member 503 may be coupled to the plate 501 and extend outwardly, away from the plate 501. In one instance, the extension member 503 may be coupled to the plate 501 between the first end 505 of the plate 501 and the second end 507 of the plate 501. The extension member 503 may contain a first end 519 and a second end 521, wherein the second end 521 is opposite the first end 519. In one instance, when the bottle holder 500 is installed, the first end 519 may be coupled to the plate 501 and the second end 521 may be the terminal end of the extension member 503. The second end 521 of the extension member 503 may be coupled to a ring 502.

In one instance, the cross section of the extension member 503 may be generally rectangular in shape. In other instances, the cross section of the extension member 503 may be generally circle shaped, oval shaped, triangle shaped, square shaped, rhombus shaped, trapezoid shaped, pentagon shaped, hexagon shaped, heptagon shaped, or octagon shaped.

Figure 26B:
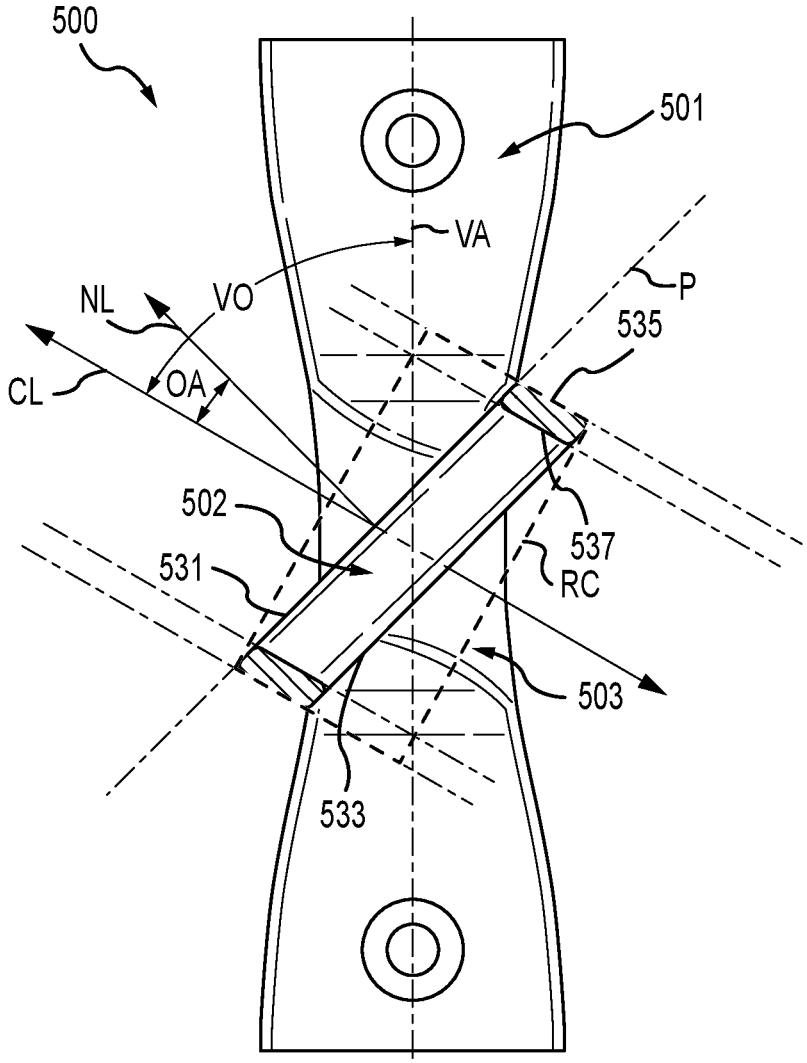
FIG. 26B is a front view of the wall-mountable bottle holder of FIG. 26A with the ring shown in cross-section so as to see the centerline and normal line associated with the holder.
Figure 26C:
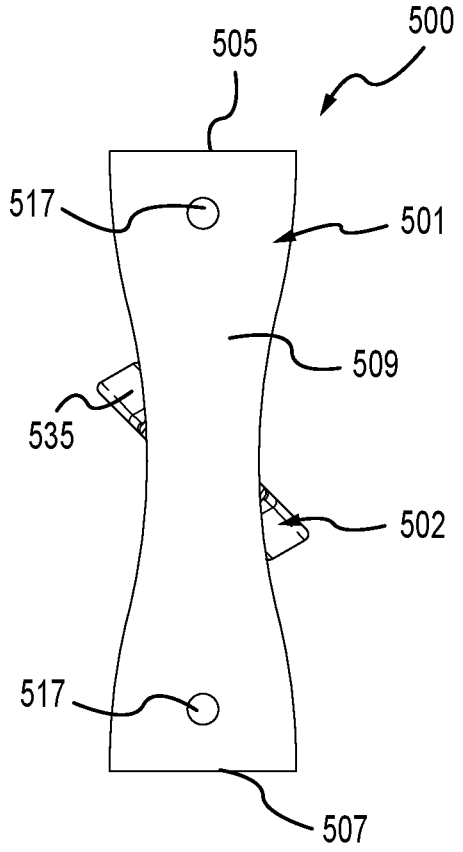
FIG. 26C is a back view of the wall-mountable bottle holder of FIG. 26A.
Figure 26D:
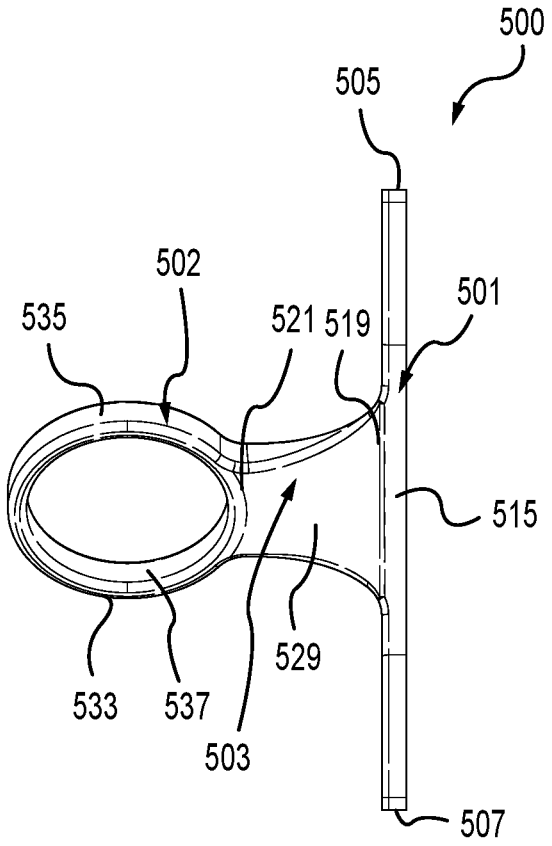
FIG. 26D is a side view of the wall-mountable bottle holder of FIG. 26A.
Figure 26E:
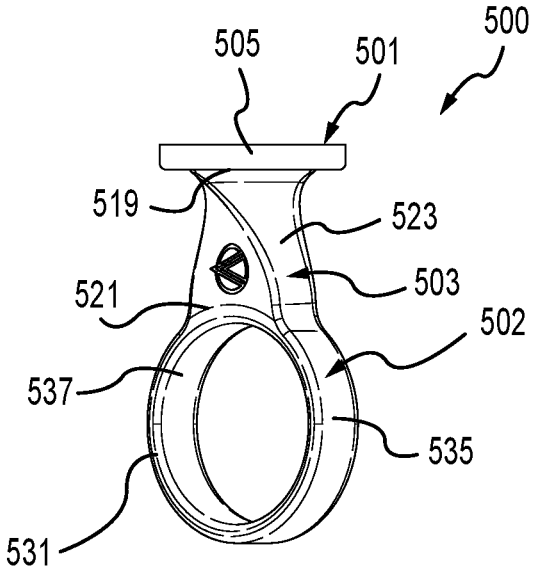
FIG. 26E is a top view of the wall-mountable bottle holder of FIG. 26A.
Figure 26F:
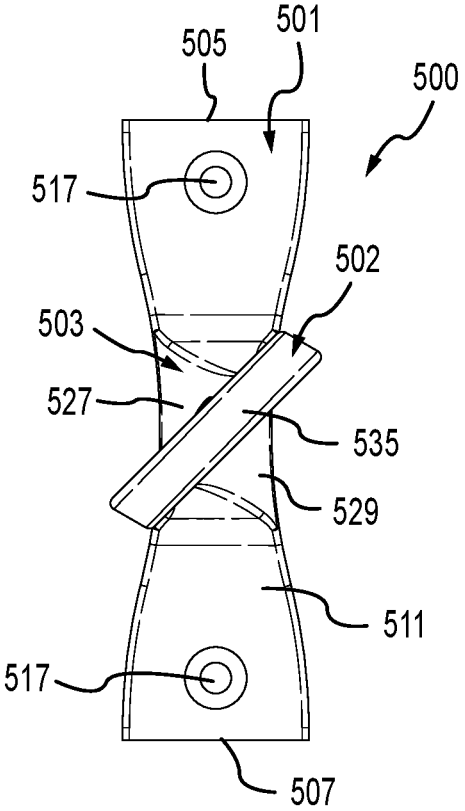
FIG. 26F is a front view of the wall-mountable bottle holder of FIG. 26A.
Figure 26G:
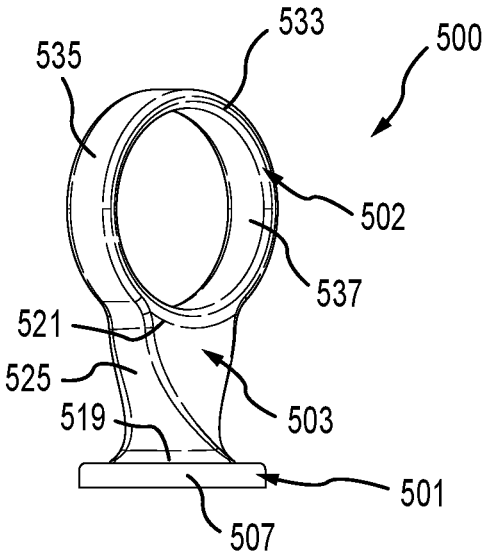
FIG. 26G is a bottom view of the wall-mountable bottle holder of FIG. 26A.
Figure 26H:
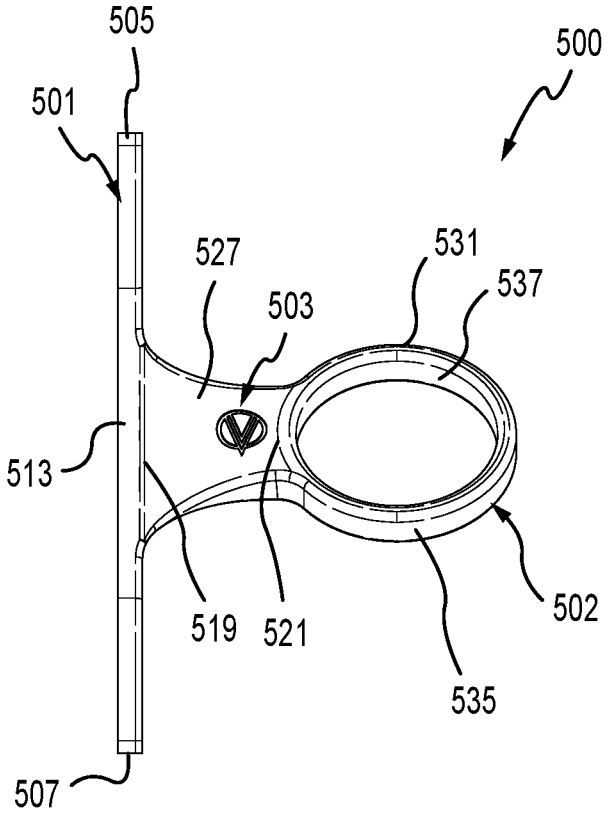
FIG. 26H is a side view of the wall-mountable bottle holder of FIG. 26A.
Figure 27A:
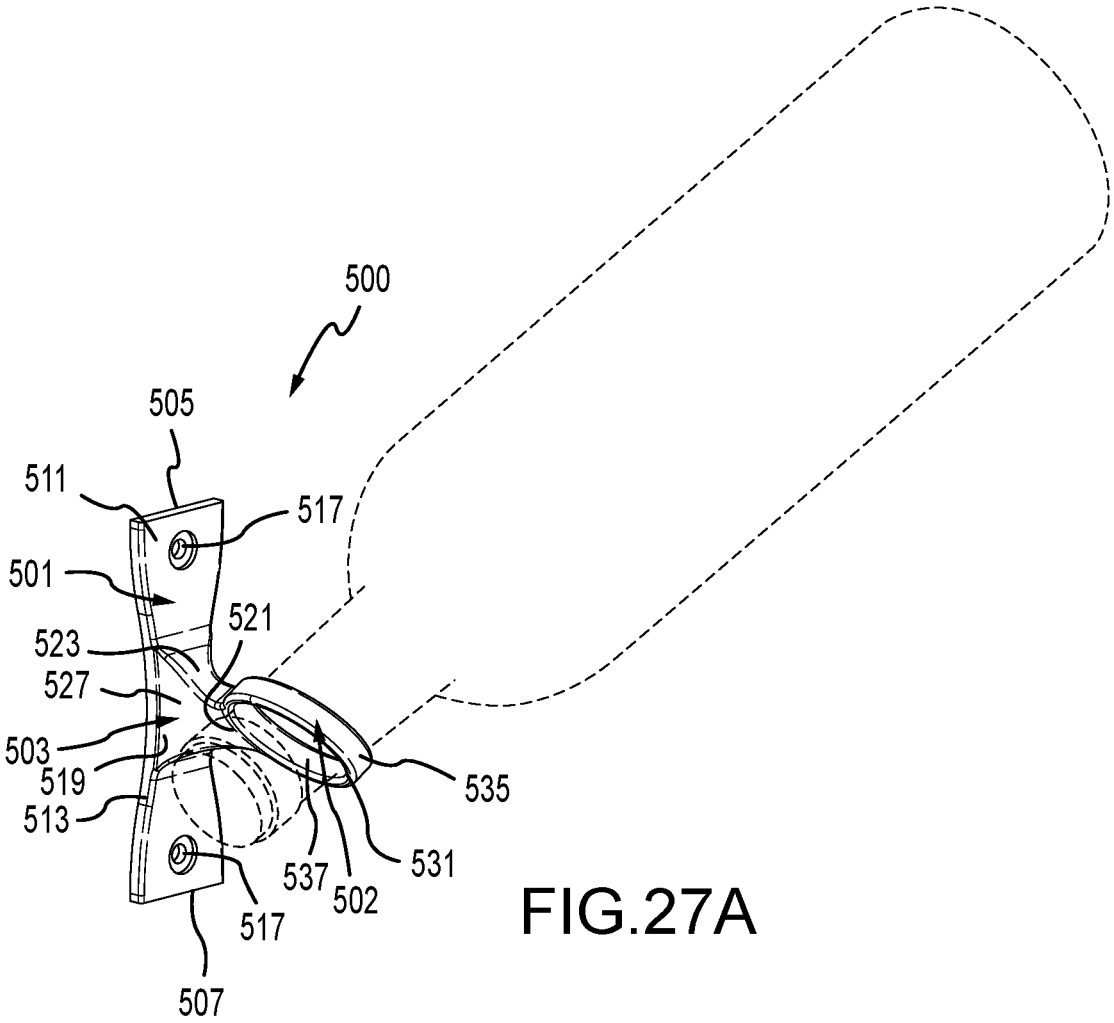
FIG. 27A is a perspective view of one instance of a wall-mountable bottle holder that is a slightly modified version of the wall-mountable bottle holder of FIGS. 26A-H where the ring orients the bottle in an opposite direction relative to the vertical axis.
Figure 27B:
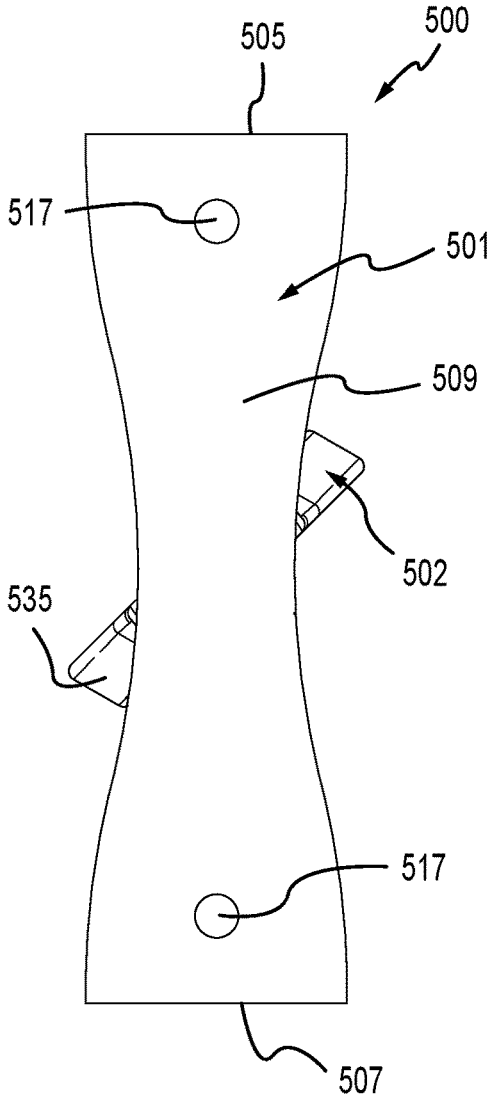
FIG. 27B is a back view of the wall-mountable bottle holder of FIG. 27A.
Figure 27C:
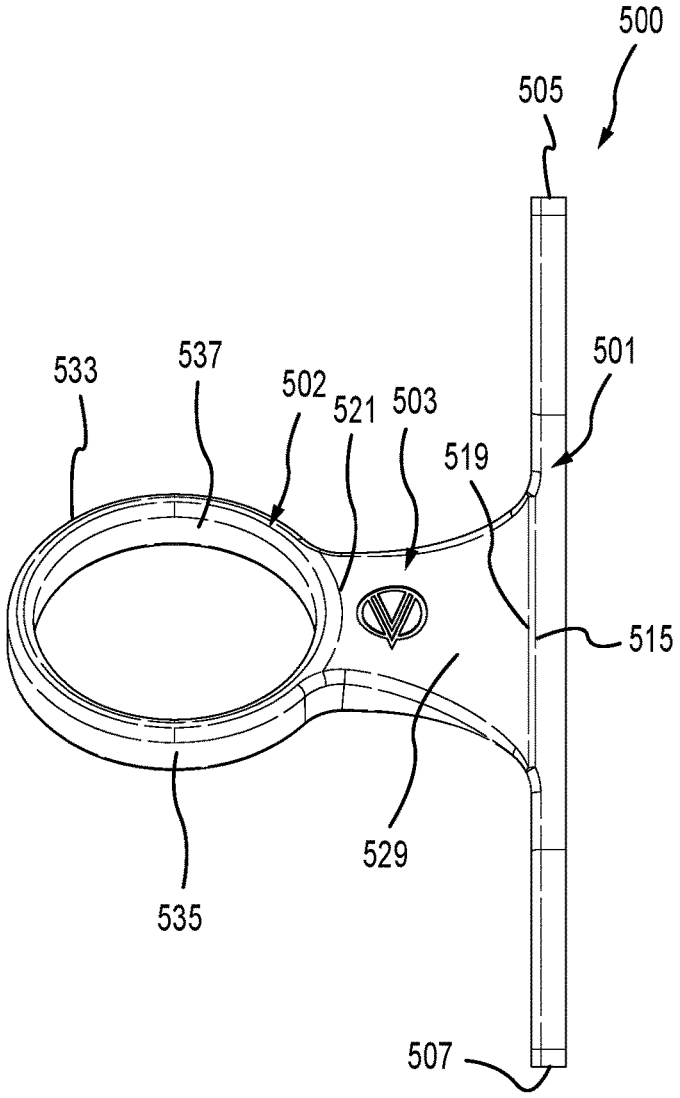
FIG. 27C is a side view of the wall-mountable bottle holder of FIG. 27A.
Figure 27D:
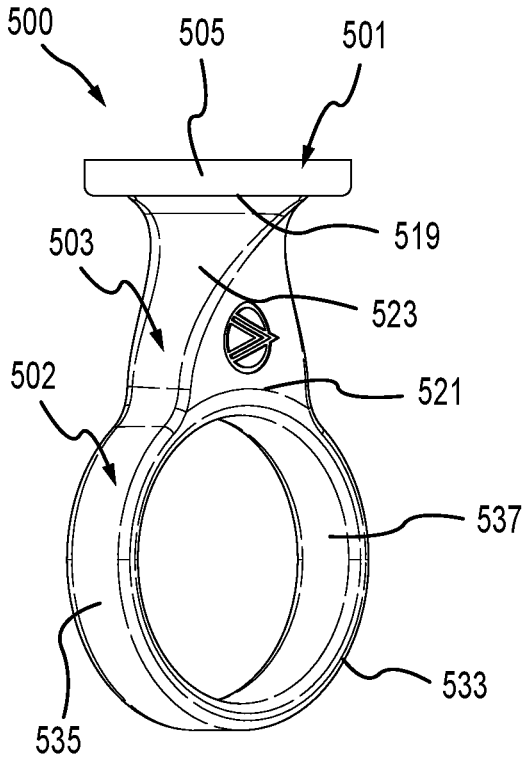
FIG. 27D is a top view of the wall-mountable bottle holder of FIG. 27A.
Figure 27E:
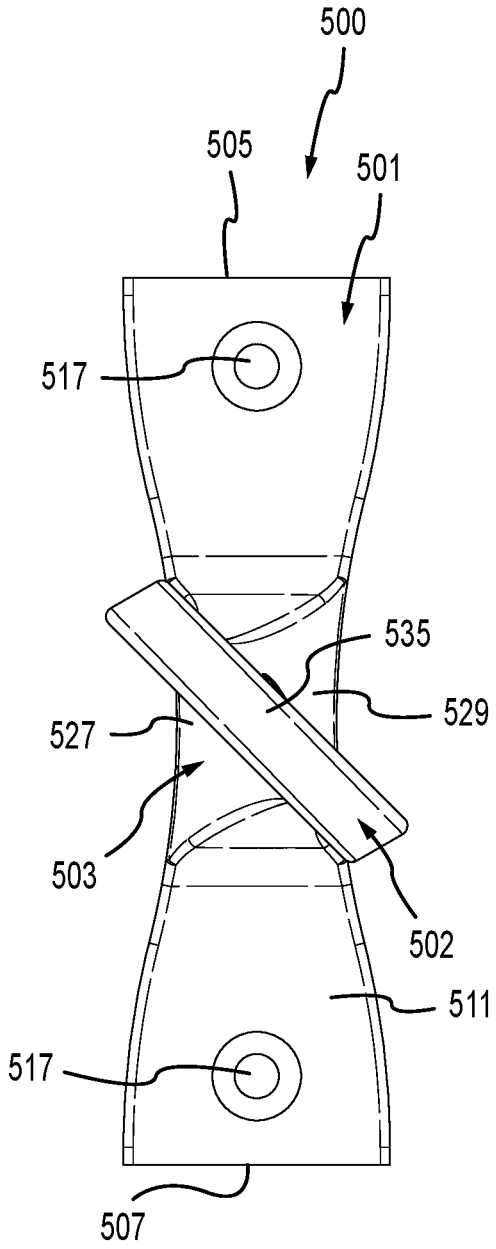
FIG. 27E is a front view of the wall-mountable bottle holder of FIG. 27A.
Figure 27F:
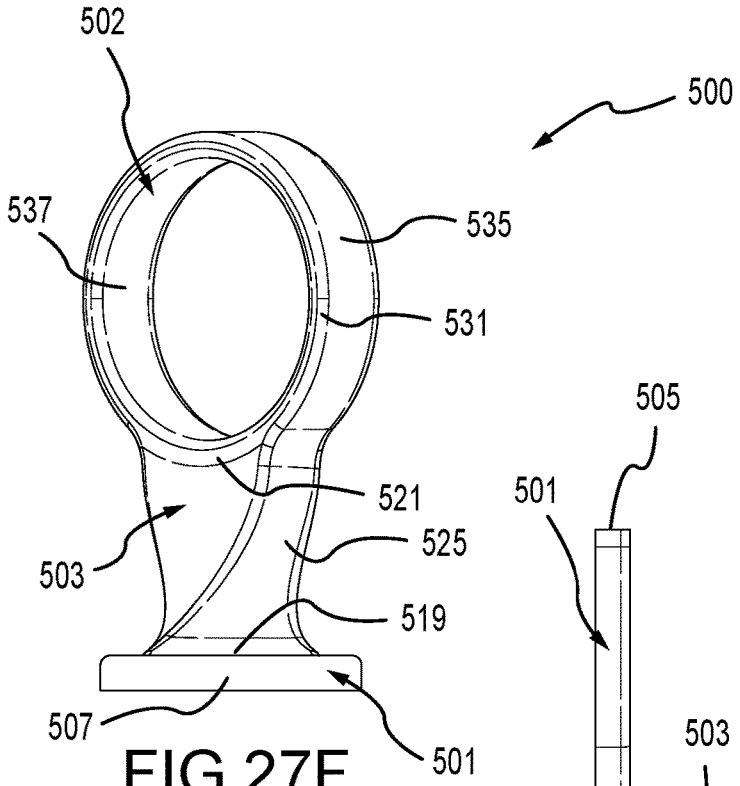
FIG. 27F is a bottom view of the wall-mountable bottle holder of FIG. 27A.
Figure 27G:
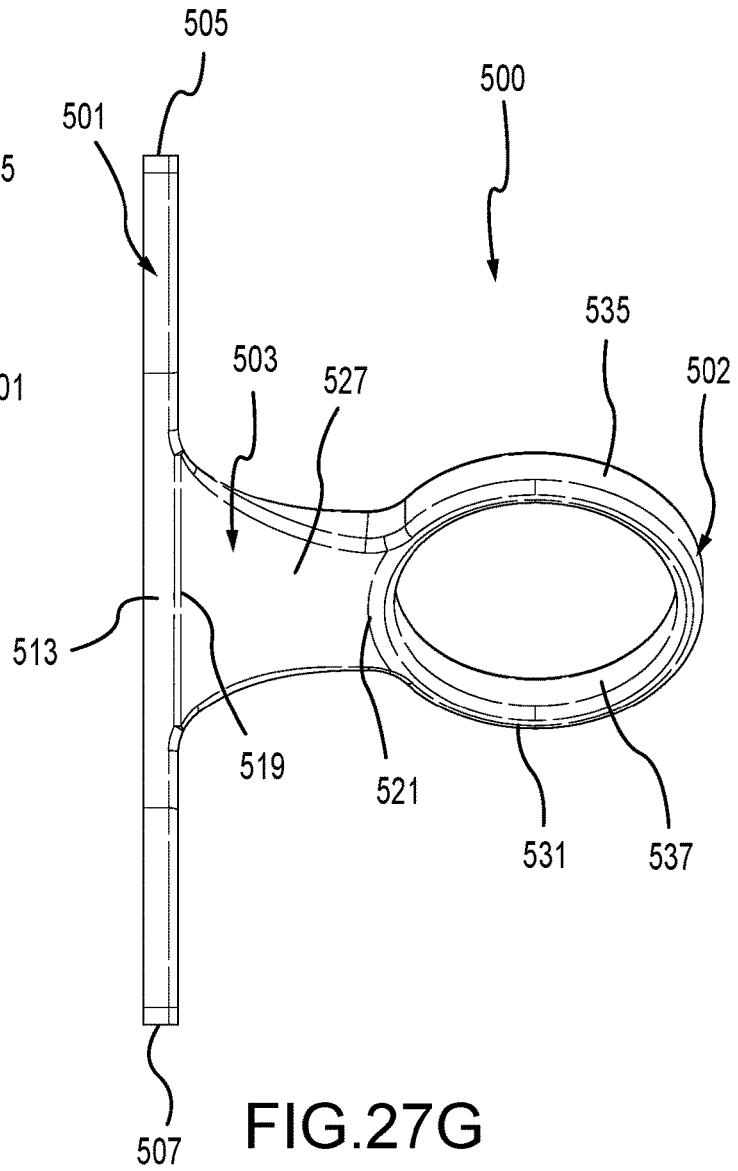
FIG. 27G is a side view of the wall-mountable bottle holder of FIG. 27A.
Figure 28A:
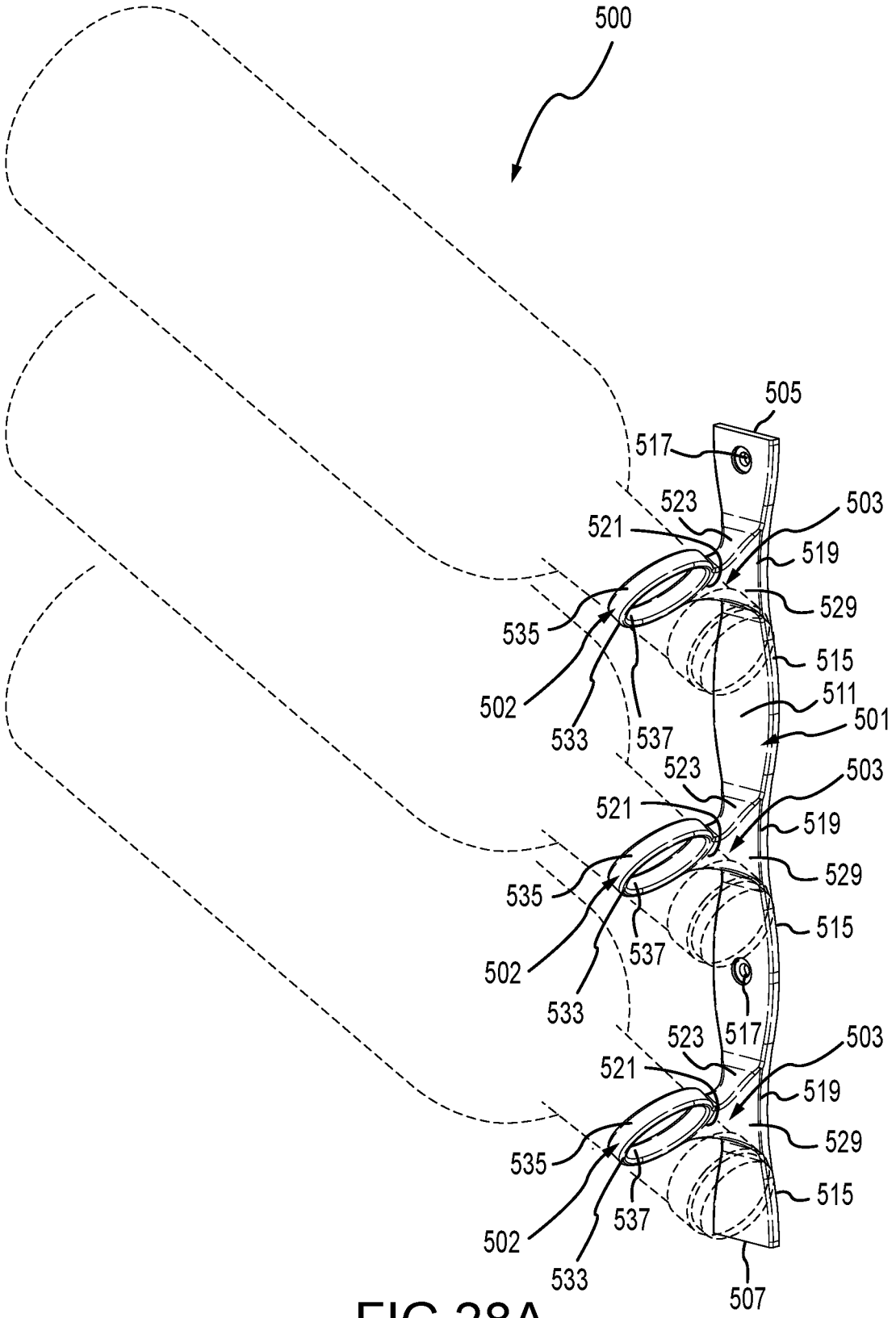
FIG. 28A is a perspective view of one instance of a wall-mountable bottle holder with multiple bottle holders.
Figure 28B:
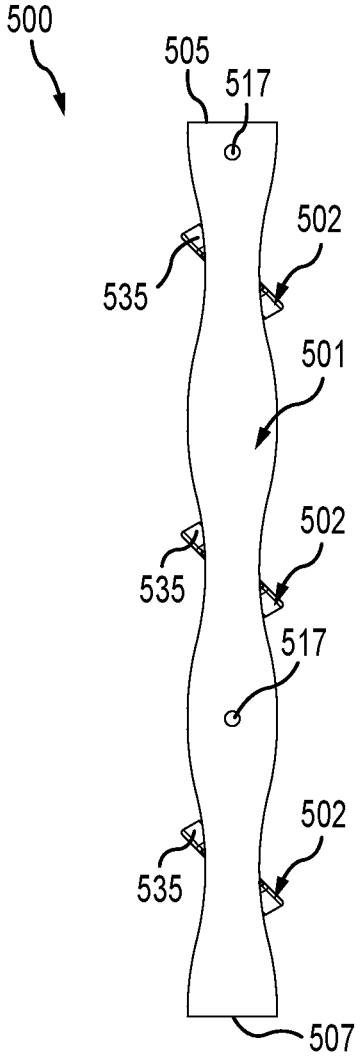
FIG. 28B is a back view of the wall-mountable bottle holder of FIG. 28A.
Figure 28C:
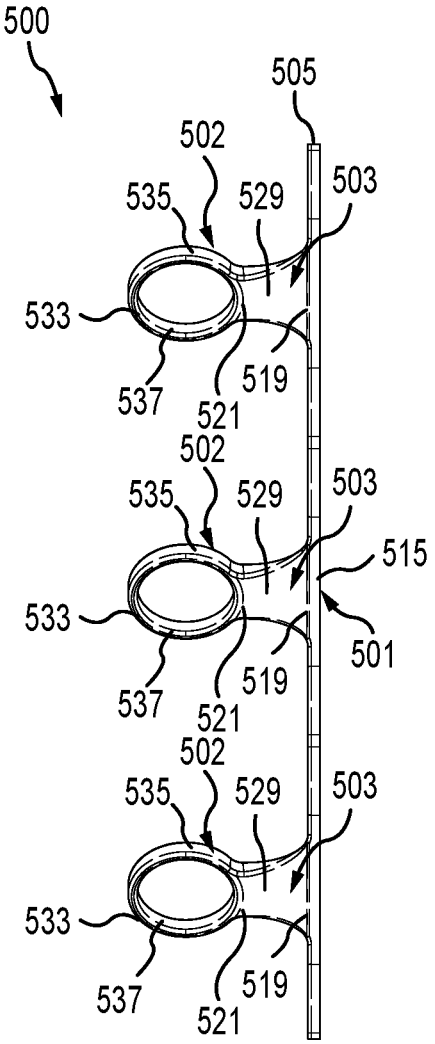
FIG. 28C is a side view of the wall-mountable bottle holder of FIG. 28A.
Figure 28D:
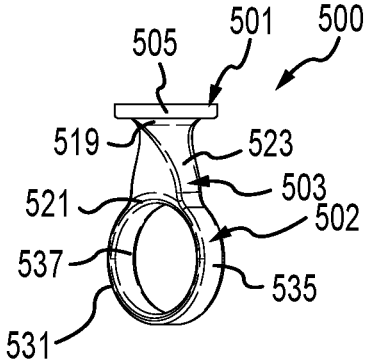
FIG. 28D is a top view of the wall-mountable bottle holder of FIG. 28A.
Figure 28E:
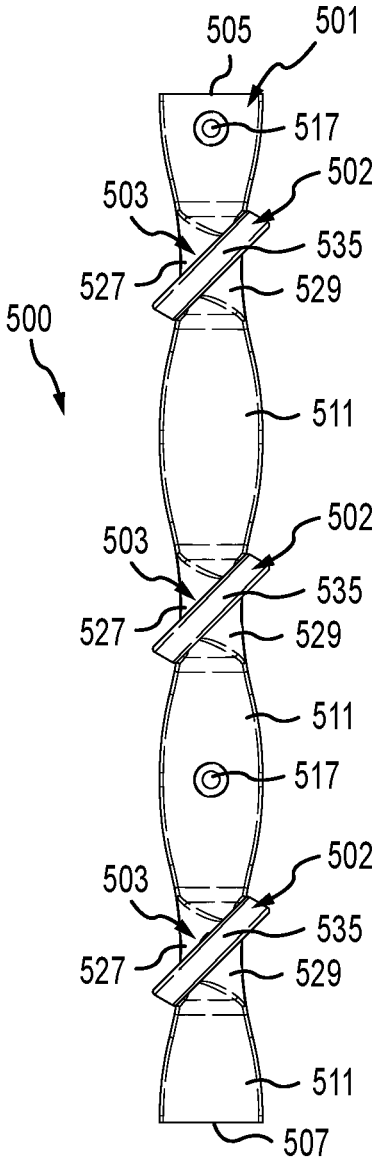
FIG. 28E is a front view of the wall-mountable bottle holder of FIG. 28A.
Figure 28F:
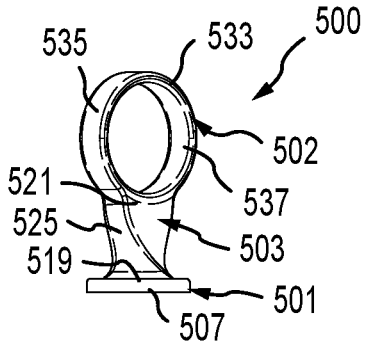
FIG. 28F is a bottom view of the wall-mountable bottle holder of FIG. 28A.
Figure 28G:
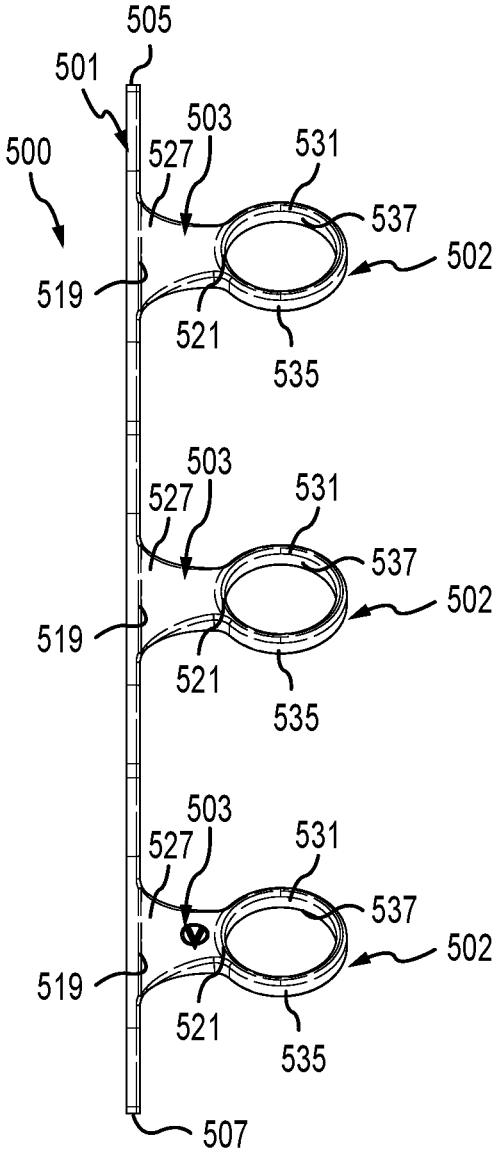
FIG. 28G is a side view of the wall-mountable bottle holder of FIG. 28A.
Figure 29A:
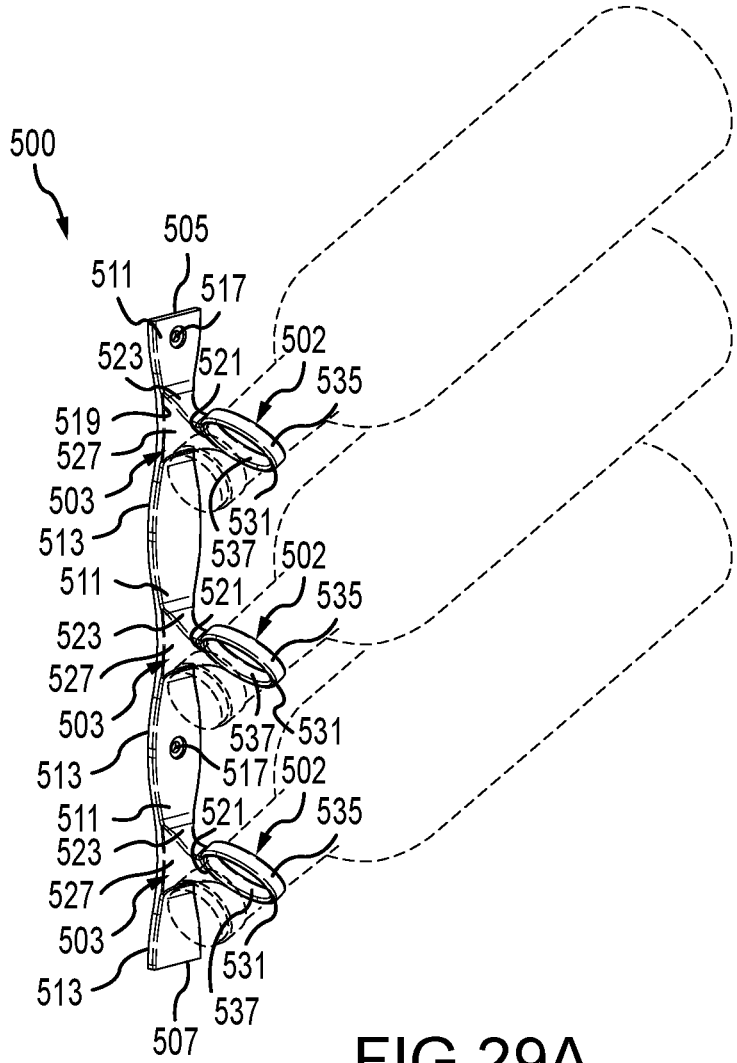
FIG. 29A is a perspective view of one instance of a wall-mountable bottle holder that is a slightly modified version of the wall-mountable bottle holder of FIGS. 28A-G where the rings orient the bottles in an opposite direction relative to the vertical axis.
Figure 29B:
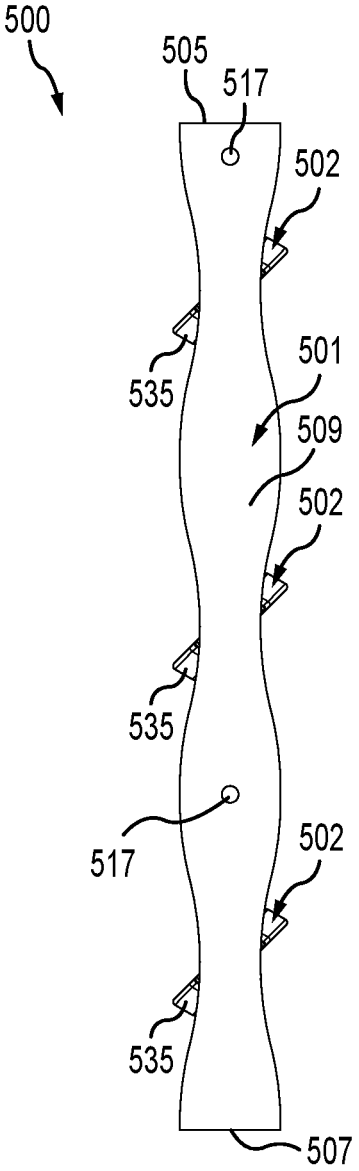
FIG. 29B is a back view of the wall-mountable bottle holder of FIG. 29A.
Figure 29C:
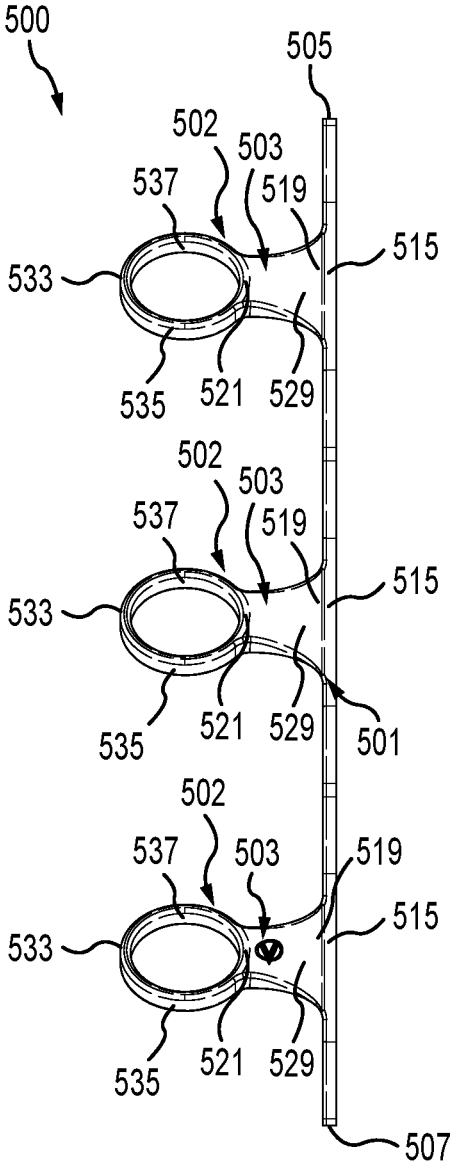
FIG. 29C is a side view of the wall-mountable bottle holder of FIG. 29A.
Figure 29D:
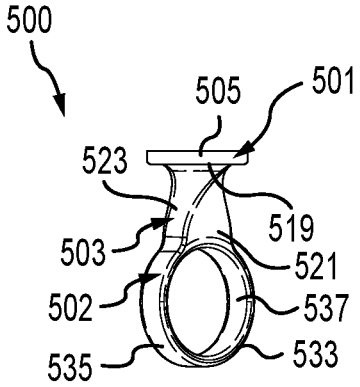
FIG. 29D is a top view of the wall-mountable bottle holder of FIG. 29A.
Figure 29E:
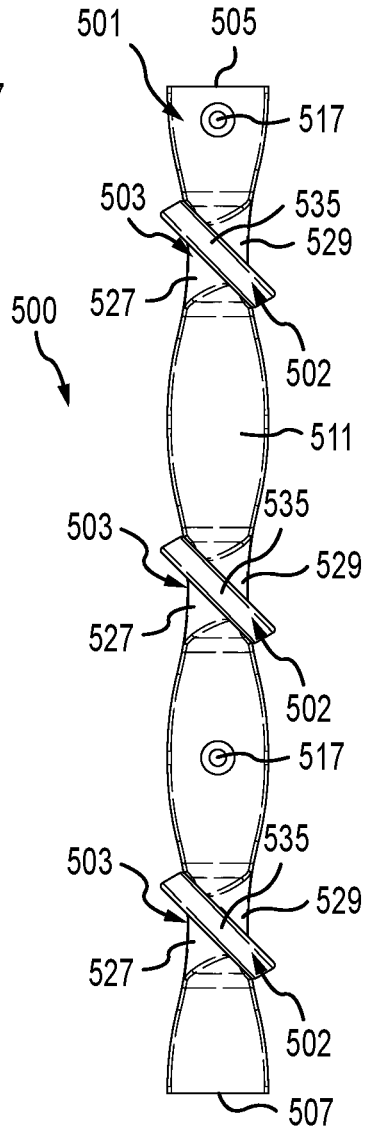
FIG. 29E is a front view of the wall-mountable bottle holder of FIG. 29A.
Figure 29F:
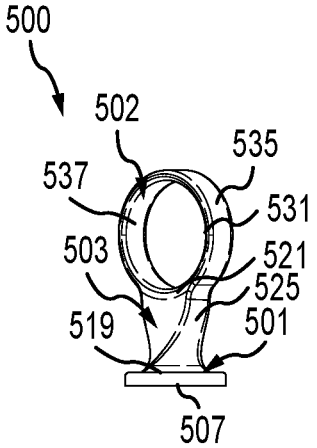
FIG. 29F is a bottom view of the wall-mountable bottle holder of FIG. 29A.
Figure 29G:
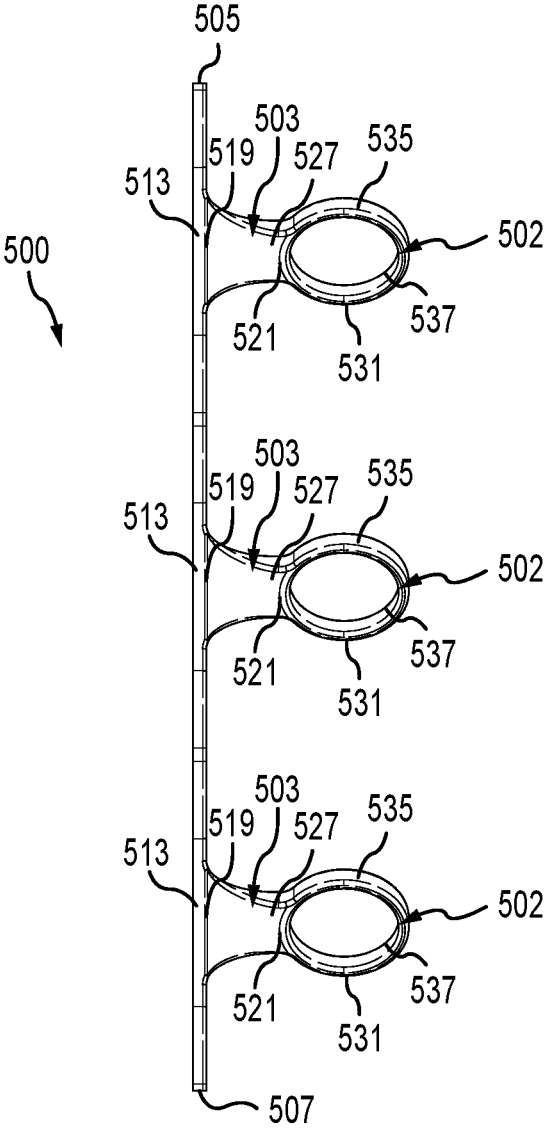
FIG. 29G is a side view of the wall-mountable bottle holder of FIG. 29A.
Figure 30A:
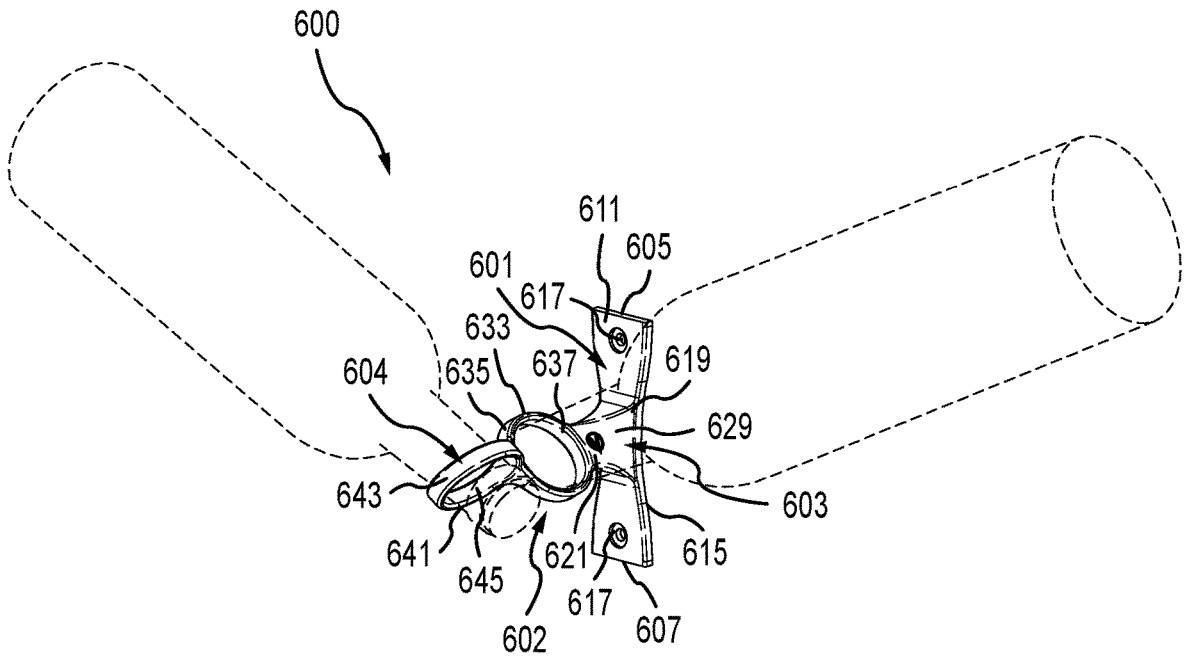
FIG. 30A is a perspective view of one instance of a wall-mountable dual bottle holder where the rings orient the bottles in an opposing fashion.
Figure 30B:
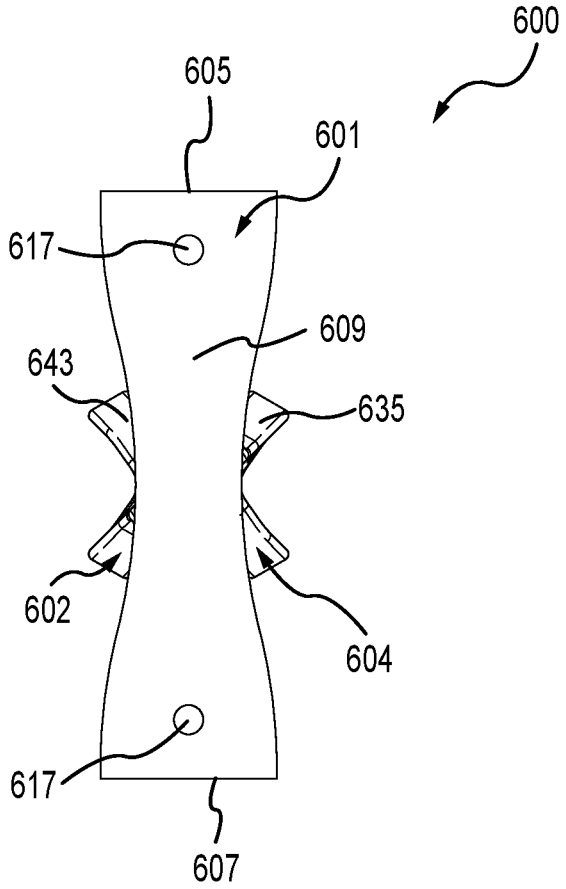
FIG. 30B is a back view of the wall-mountable bottle holder of FIG. 30A.
Figure 30C:
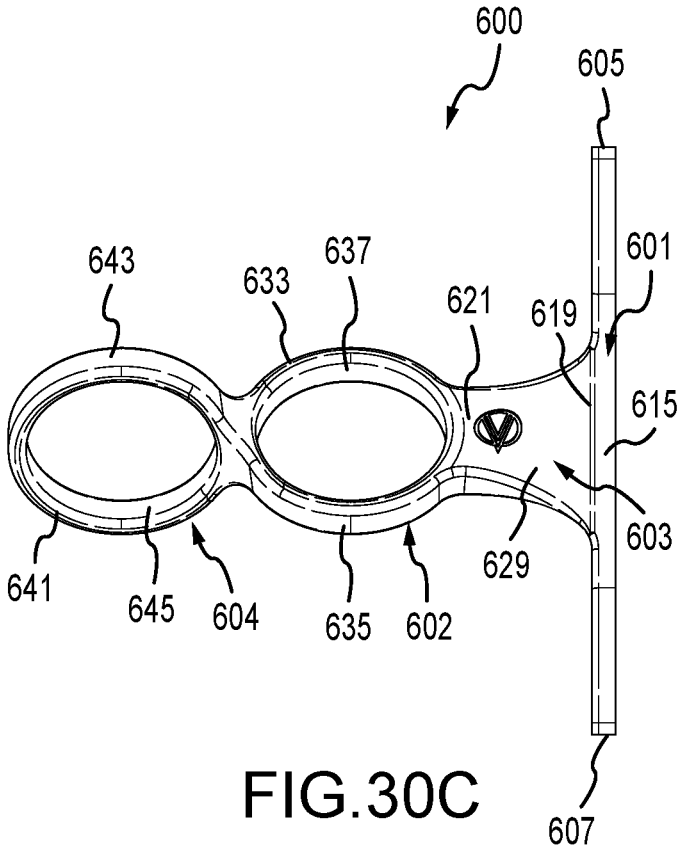
FIG. 30C is a side view of the wall-mountable bottle holder of FIG. 30A.
Figure 30D:
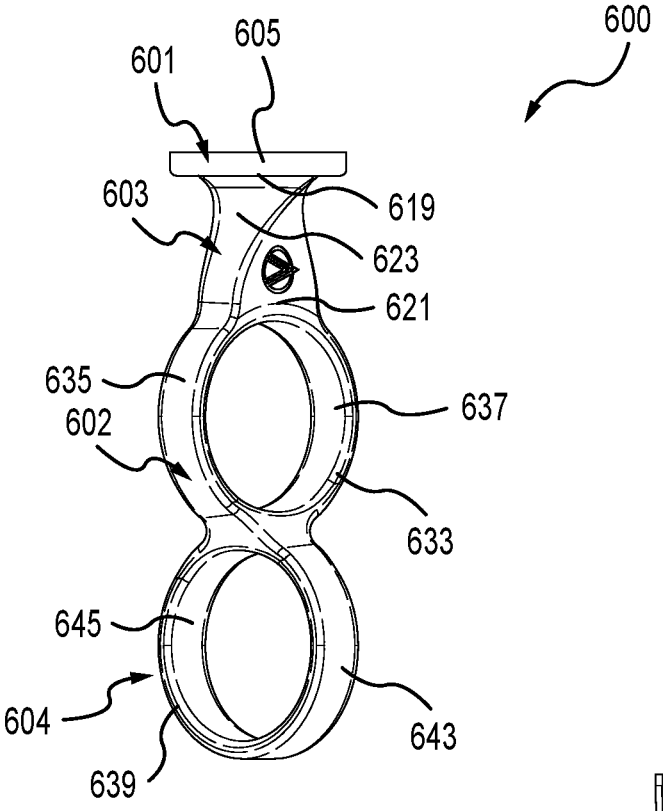
FIG. 30D is a top view of the wall-mountable bottle holder of FIG. 30A.
Figure 30E:
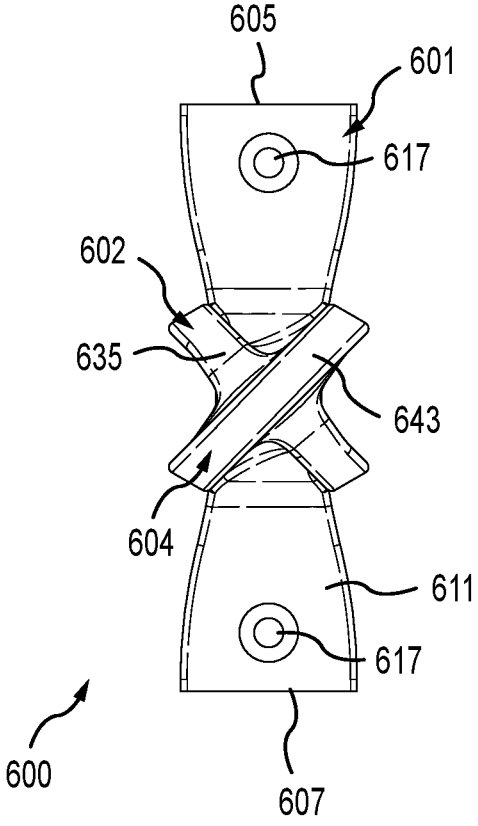
FIG. 30E is a front view of the wall-mountable bottle holder of FIG. 30A.
Figure 30F:
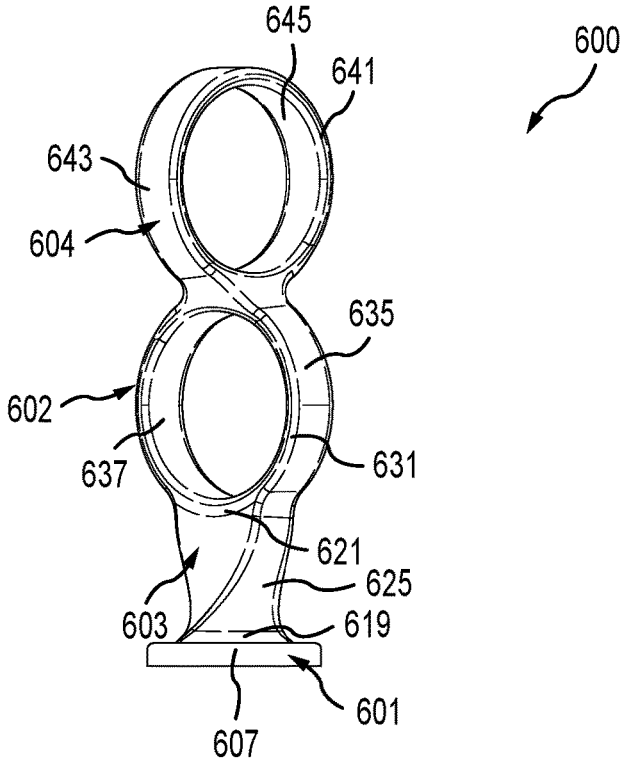
FIG. 30F is a bottom view of the wall-mountable bottle holder of FIG. 30A.
Figure 30G:
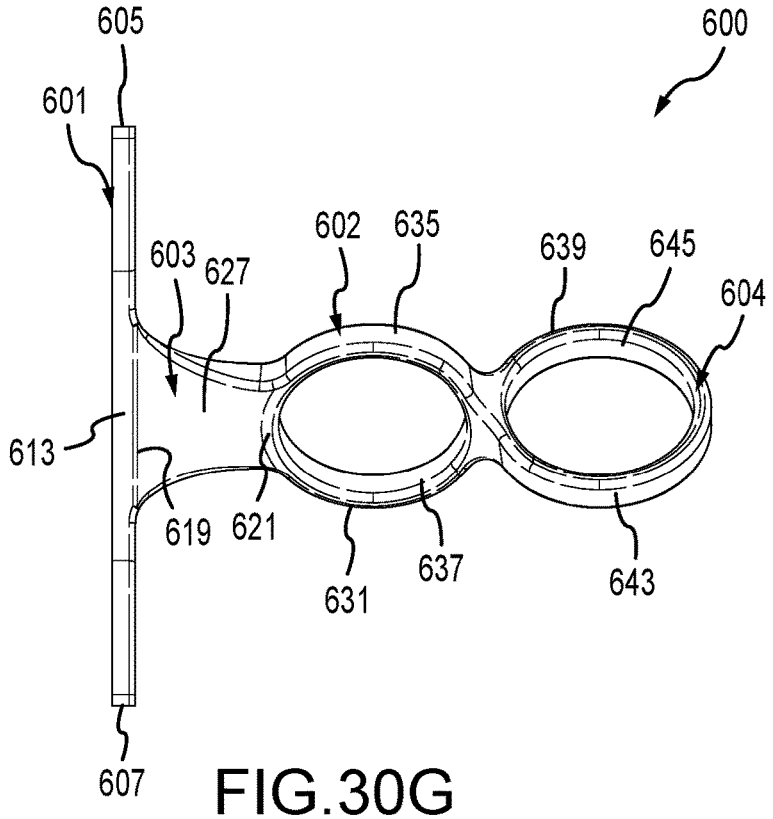
FIG. 30G is a side view of the wall-mountable bottle holder of FIG. 30A.
Figure 31A:
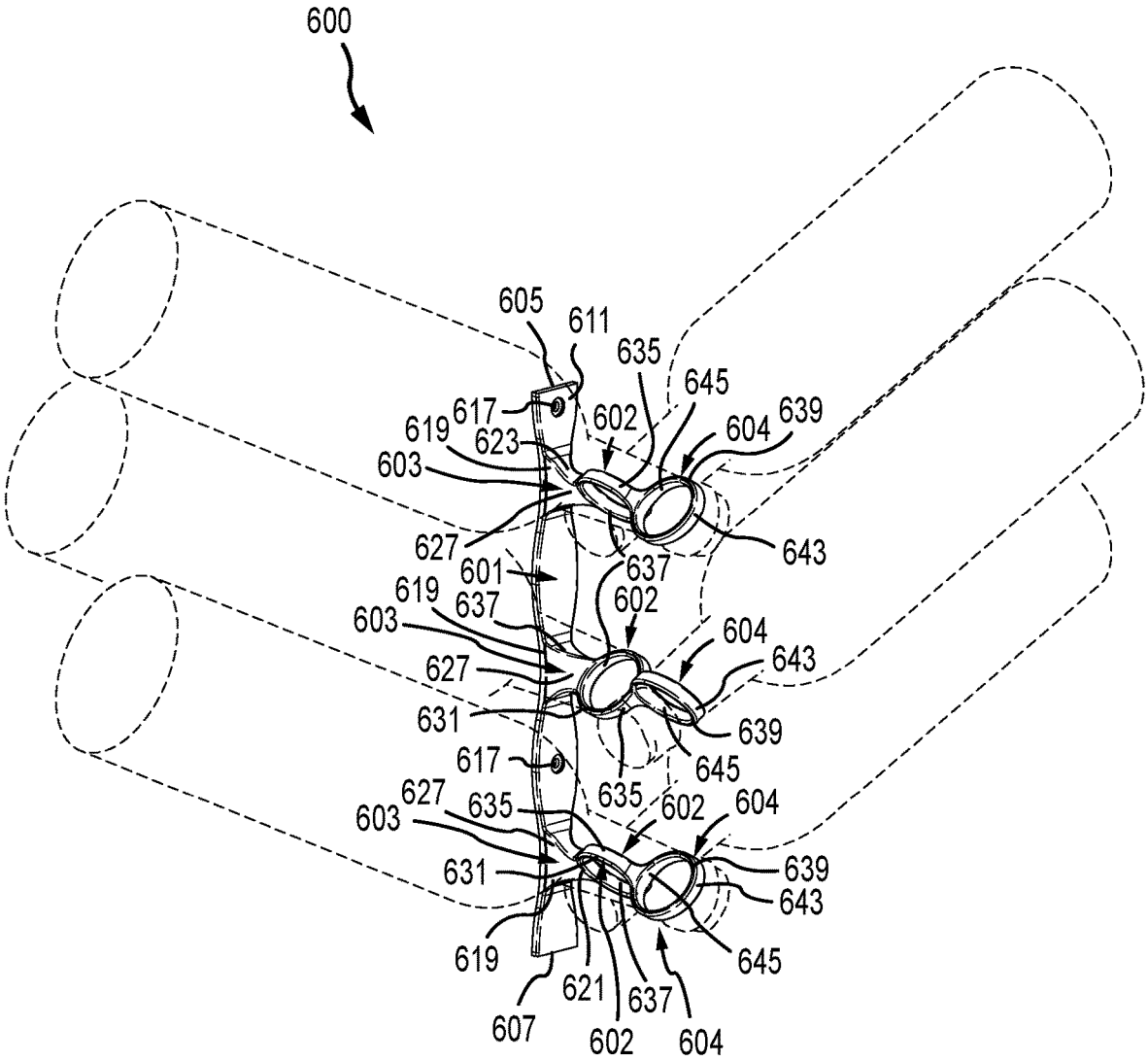
FIG. 31A is a perspective view of one instance of a wall-mountable dual bottle holder with multiple bottle holders where the rings orient the bottles in an opposing fashion.
Figure 31B:
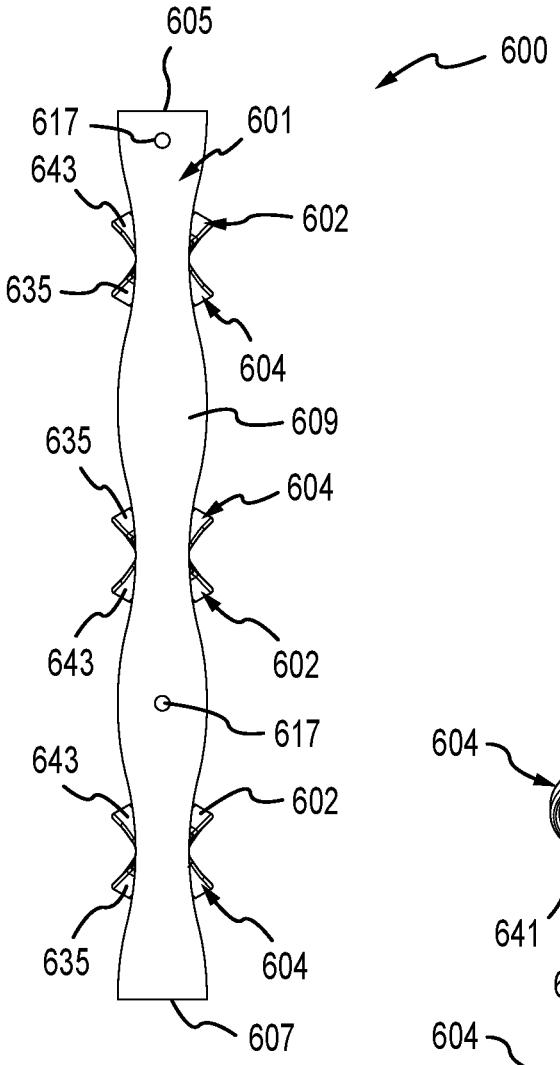
FIG. 31B is a back view of the wall-mountable bottle holder of FIG. 31A.
Figure 31C:
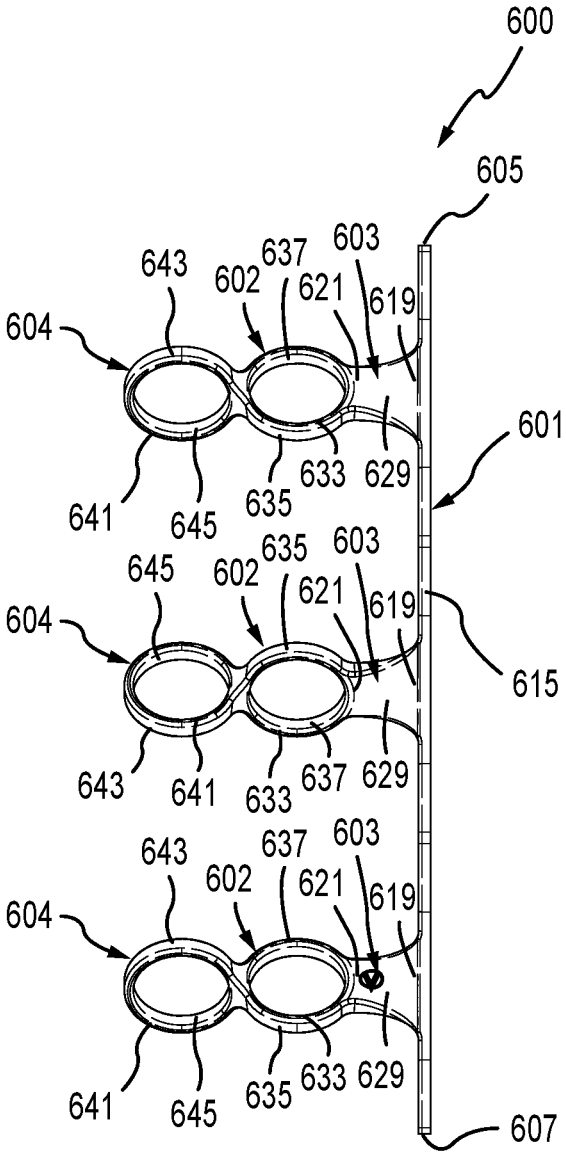
FIG. 31C is a side view of the wall-mountable bottle holder of FIG. 31A.
Figure 31D:
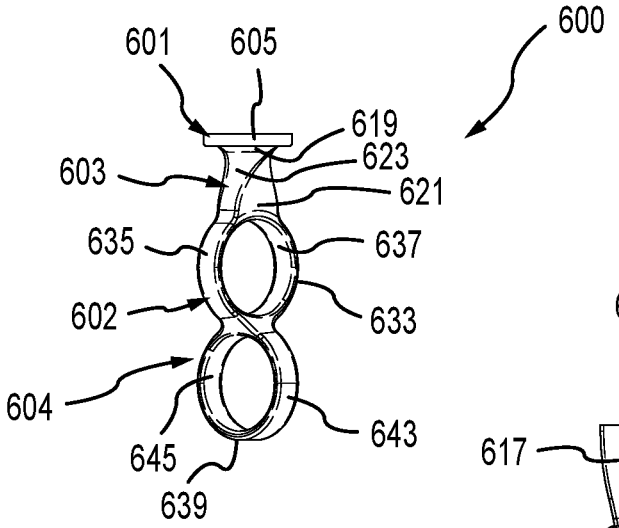
FIG. 31D is a top view of the wall-mountable bottle holder of FIG. 31A.
Figure 31E:
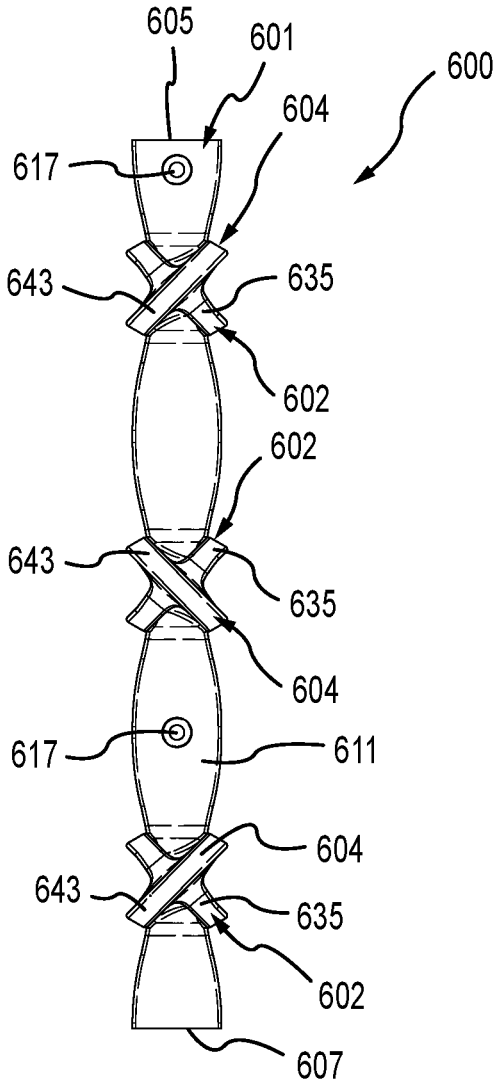
FIG. 31E is a front view of the wall-mountable bottle holder of FIG. 31A.
Figure 31F:
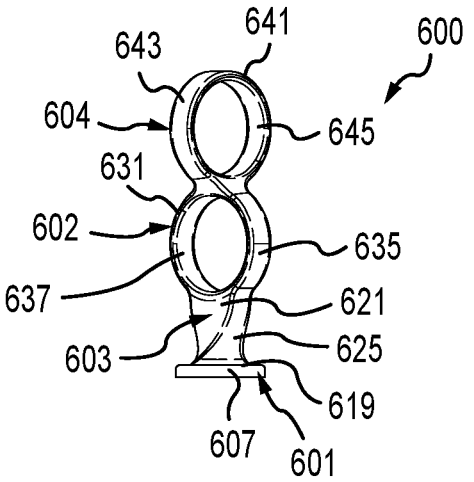
FIG. 31F is a bottom view of the wall-mountable bottle holder of FIG. 31A.
Figure 31G:
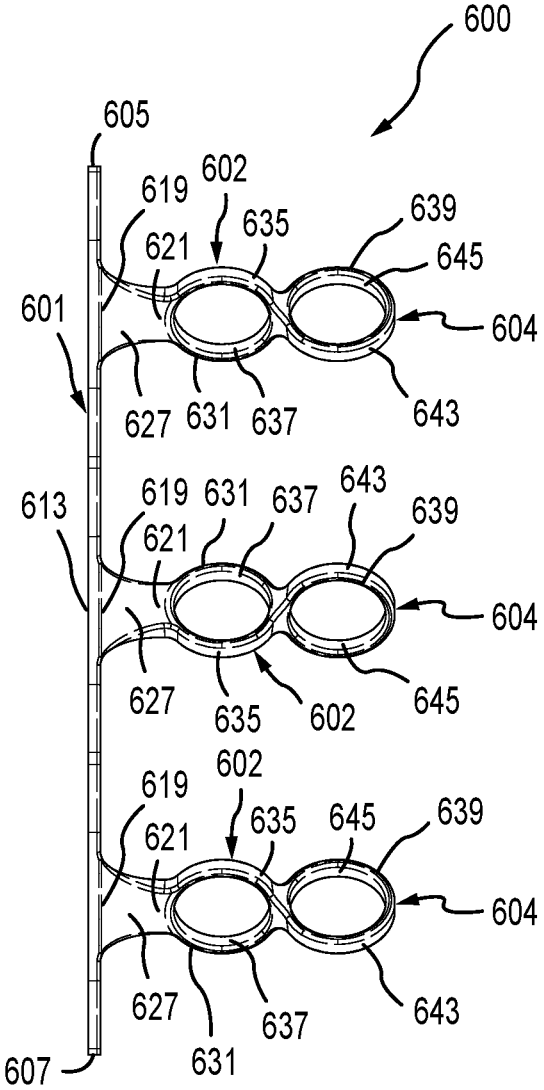
FIG. 31G is a side view of the wall-mountable bottle holder of FIG. 31A.

The extension member 503 may contain a first edge 523, as seen in FIG. 26E, and a second edge 525, as seen in FIG. 26G, wherein the second edge 525 is opposite the first edge 523. In one instance, when the bottle holder 500 is installed, the first edge 523 may be the top edge of the extension member 503 and the second edge 525 may be the bottom edge of the extension member 503. The distance between the first edge 523 and the second edge 525 may define a vertical thickness of the extension member 503. In one instance, the extension member 503 may include in-cuts at the first edge 523 and/or second edge 525, thereby defining a waist of the extension member 503 in the vertical direction. In one instance, the first edge 523 and/or the second edge 525 might not be planar. For example, the first edge 523 and/or the second edge 525 may contain an in-cut and/or may be twisted. In other instances, the first edge 523 and/or the second edge 525 may be planar.

The extension member 503 may contain a first side edge 527 and a second side edge 529, wherein the second side edge 529 is opposite the first side edge 527. In one instance, when the bottle holder 500 is installed, the first side edge 527 may be the left side of the extension member 503 and the second side edge 529 may be the right side of the extension member 503. The distance between the first side edge 527 and the second side edge 529 may define a horizontal thickness of the extension member 503. In one instance, the extension member 503 may include in-cuts at first side edge 527 and/or second side edge 529, thereby defining a waist of the extension member 503 in the horizontal direction. In one instance, the first side edge 527 and/or the second side edge 529 might not be planar. For example, the first side edge 527 and/or the second side edge 529 may contain an in-cut and/or may be twisted. In other instances, the first side edge 527 and/or the second side edge 529 may be planar.

In one instance, the extension member 503 may be generally perpendicular to the plate 501. In other words, the extension member 503 may form two right angles with respect to the plate 501 in the horizontal direction (i.e., to the left and to the right of the extension member 503) and two right angles with respect to the plate 501 in the vertical direction (i.e., above and below the extension member 503). Thus, the extension member 503 may extend horizontally outward away from the plate 501 when the bottle holder 500 is mounted to a vertical surface such as a wall. In other instances, the extension member 503 may be oblique (i.e., not perpendicular) to the plate 501. In other words, the extension member 503 may form an acute angle and an obtuse angle with respect to the plate 501 in the horizontal direction and/or the extension member 503 may form an acute angle and an obtuse angle with respect to the plate 501 in the vertical direction.

Continuing with FIGS. 26A-H, a ring 502 may be coupled to the second end 521 of the extension member 503. The ring 502 may be configured to receive a portion of a bottle. In other words, the bottle holder 500 supports the bottle when the ring 502 receives a portion of the bottle. The bottle holder 500 may be used to support any bottle, such as a glass bottle or a plastic bottle. For example, the bottle holder 500 may hold beverage bottle. In some instances, the bottle holder 500 may hold a wine bottle, a beer bottle, or a liquor bottle.

As best seen in FIG. 26B, which is a front view of the bottle holder 500 with the ring 502 in cross-section, the ring 502 may be an oblique cylindrical body. A right cylinder RC is overlaid on the oblique cylindrical body and is shown in broken line. The right cylinder RC contains a circular first base, a circular second base that is parallel to the first base, and a cylindrical or curvate surface that connects the circular first base to the circular second base. Additionally, a segment that would connect the center of the first base to the center of the second base is perpendicular to the first base and the second base. Thus, the cylindrical surface connecting the circular first base to the circular second base is perpendicular to both the circular first base and the circular second base. Conversely, an oblique cylinder contains a first base which is angled relative to the first base of the right cylinder RC. The oblique cylinder also includes a second base which is angled relative to the second base of the right cylinder RC and that is parallel to the first base. A curved or cylindrical surface connects the first base to the second base. Additionally, a segment that would connect the center of the first base to the center of the second base is oblique (i.e., not perpendicular) to the first base and the second base. Thus, the curved surface connecting the first base to the second base is oblique to both the first base and the second base.

As best seen in FIG. 26B, the oblique cylindrical body of the ring 502 may have a first end surface 531 and a second end surface 533, wherein the second end surface 533 is opposite the first end surface 531. In one instance, when the bottle holder 500 is installed, the first end surface 531 may be the left side of the ring 502 and the second end surface 533 may be the right side of the ring 502. The second end surface 533 and the first end surface 531 may be parallel to each other. The first end surface 531 may be oblique (i.e., not perpendicular) to the oblique cylindrical body and, as a result, the first end surface 531 may be oval shaped. The first end surface 531 may define an oblique opening, which may be oval shaped. Similarly, the second end surface 533 may be oblique with respect to the oblique cylindrical body and, as a result, the second end surface 533 may be oval shaped. The second end surface 533 may define an oblique opening, which may be oval shaped.

The oblique cylindrical body of the ring 502 may include an outer cylindrical surface 535 and/or an inner cylindrical surface 537, as seen in FIG. 26B. The first end surface 531 may be oblique (i.e., not perpendicular) with respect to the outer cylindrical surface 535 and/or inner cylindrical surface 537. Additionally, the second end surface 533 may be oblique with respect to the outer cylindrical surface 535 and/or inner cylindrical surface 537. The inner cylindrical surface 537 may be configured to receive the neck of a bottle.

As seen in FIG. 26B, the oblique cylindrical body of the ring 502 may include a centerline CL that is coaxial with the inner cylindrical surface 537. The center line CL is also parallel with the extension lines that extend from the inner cylindrical surface 537 in FIG. 26B. The oblique cylindrical body may be oriented so that the centerline CL forms a vertically offset angle VO between 15-degrees and 75-degrees with respect to a vertical axis VA when the plate 501 is mounted to a surface. For example, in one instance, the oblique cylindrical body may be oriented so that the centerline CL forms a vertically offset angle VO of about 45-degrees with respect to the vertical axis VA. For example, in one instance, the oblique cylindrical body may be oriented so that the centerline CL forms a vertically offset angle VO of about 67-degrees with respect to the vertical axis VA (about 23-degrees with respect to a horizontal axis). For example, in one instance, the oblique cylindrical body may be oriented so that the centerline CL forms a vertically offset angle VO of about 60-degrees with respect to the vertical axis VA (about 30-degrees with respect to a horizontal axis). For example, in one instance, the oblique cylindrical body may be oriented so that the centerline CL forms a vertically offset angle VO of about 30-degrees with respect to the vertical axis VA (about 60-degrees with respect to a horizontal axis).

The longitudinal axis of the bottle (not shown in FIG. 26B) may be oriented at a slightly different angle than the centerline CL of the oblique cylindrical body of the ring 502. In one instance, the longitudinal axis of the bottle may be angled slightly less with respect to a horizontal axis (slightly greater with respect to the vertical axis VA) than the centerline CL of the oblique cylindrical body of the ring 502 because gravity will cause the bottle to rotate around the ring 502. Thus, if a certain angle of the bottle is desired, then a slightly different angle must be provided for the centerline CL of the ring 502 to account for the bottle tending to rotate about the ring 502. In one instance, the oblique cylindrical body of the ring 502 may be configured to hold a bottle at an angle of about 23-degrees with respect to a horizontal axis (about 67-degrees with respect to the vertical axis VA). In another instance, the oblique cylindrical body of the ring 502 may be configured to hold a bottle at an angle of about 30-degrees with respect to a horizontal axis (about 60-degrees with respect to the vertical axis VA).

Still referring to FIG. 26B, the first and second end surfaces 531, 533 are parallel to each other. The first and second end surfaces 531, 533 are, however, not perpendicular to the inner cylindrical surfaces 537 since the ring 502 is not a right cylinder. Because the ring 502 is an oblique cylindrical body, a plane P defined by the first and/or second end surface 531, 533 has a normal line NL (centered on the oblique opening) that is not coincident with the centerline CL (which is coaxial with the inner cylindrical surface 537). An offset angle OA is defined between the centerline CL and the normal line NL. In one instance, the offset angle OA is about 15 degrees. In one instance, the offset angle OA is about 10 degrees. In one instance, the offset angle OA is about 5 degrees. In one instance, the offset angle OA is about 20 degrees. In one instance, the offset angle OA is about 25 degrees. In a right cylinder RC, which is shown in broken lines, the centerline CL would be coincident with the normal line NL. By using an oblique cylindrical body for the ring 502, less material is used in the manufacture of the ring 502 as compared with a ring that is a right cylinder. The oblique cylindrical body functions to support the bottle as efficiently as a right cylinder, but it uses less material to do so. The oblique cylindrical body supports the bottle in the needed positions to counteract the bending moment of the bottle within the ring 502 (i.e., downward force on the lower portion of the ring 502 in FIG. 26B, and an upward force on the upper portion of the ring 502 in 26B). In one instance, the centerline may be parallel to the plate 501.

In one instance, the ring 502 may be configured to receive the neck of the bottle. For example, the ring 502 may be configured to receive the neck of a wine bottle. In one instance, the ring 502 may be configured to receive the wine bottle angled in a cork-down orientation. In one instance, the neck of a bottle may be inserted through the ring 502 with the bottle angled downward. The ring 502 may be configured to support the neck of the bottle with the bottle angled downward. This orientation may allow liquid within the bottle to contact the cap, cork, or otherwise seal at or near the mouth of the bottle. For example, the downward orientation of a wine bottle (i.e., cork down orientation) may allow liquid wine within the bottle to contact the cork of the wine bottle. This may keep the cork moist, thereby preventing the cork from drying out and preventing the ingress of air into the wine bottle.

A portion of the neck of the bottle may contact a portion of the inner cylindrical surface 537 of the ring 502. For example, an upward-facing portion of the inner cylindrical surface 537 may contact a downward-facing portion of the neck and a downward-facing portion of the inner cylindrical surface 537 may contact an upward-facing portion of the neck. Thus, the inner cylindrical surface 537 constrains the neck of the bottle, thereby supporting the bottle. When the portions of the inner cylindrical surface 537 are engaged with the neck of the bottle, the forces applied by the inner cylindrical surface 537 prevent the bottle from translating horizontally or vertically and also prevent rotation of the bottle.

The oblique cylindrical body of the ring 502 may provide advantages over a right cylindrical body. For example, an oblique cylindrical body may provide more surface area for the bottle to contact (i.e., contact area). The oblique cylindrical body contains an inner cylindrical surface 537 that is not perpendicular to either the first end surface 531 or the second end surface 533. As a result, the bottle may be supported by the oblique cylindrical body at two edges (i.e., the first edge is formed by the intersection of the inner cylindrical surface 537 with the first end surface 531 and the second edge is formed by the intersection of the inner cylindrical surface 537 with the second end surface 533) and/or by the inner cylindrical surface 537. In other words, the bottle may contact a greater portion of the inner cylindrical surface 537 of the oblique cylindrical body because the inner cylindrical surface 537 is not perpendicular to the bases. This greater contact area may reduce stress concentrations where the oblique cylindrical body supports the bottle. Thus, the oblique cylindrical body may provide a safer way to support a bottle.

On the other hand, a right cylindrical body may provide less surface area for a bottle to contact (i.e., contact area). A right cylindrical body would contain an inner cylindrical surface that would be perpendicular to both the first end surface and the second end surface. As a result, the bottle may be supported by the right cylindrical body only at two edges; the first edge is formed by the intersection of the inner cylindrical surface with the first end surface and the second edge is formed by the intersection of the inner cylindrical surface with the second end surface. This lesser contact area might increase stress concentrations where the right cylindrical body supports the bottle.

FIGS. 27A-G illustrate one instance of a bottle holder 500 that includes the same features as the bottle holder 500 described in FIGS. 26A-H; however, the bottle holder 500 in FIGS. 27A-27G includes the ring 502 in a different orientation. Due to the same features, the reference numbers and the description for the bottle holder 500 in FIGS. 26A-H are also applicable to the bottle holder 500 in FIGS. 27A-G.

The bottle holder 500 includes a plate 501, an extension member 503 coupled to the plate 501 and extending outwards from the plate 501, and a ring 502 coupled to the extension member 503 and configured to receive a portion of a bottle. However, the ring 502 illustrated in FIGS. 27A-G is mirror-imaged about a vertical axis (i.e., in the opposite orientation with respect to a vertical axis) from the ring 502 illustrated in FIGS. 26A-H. Thus, due to the orientation of the ring 502 in FIGS. 27A-G, the body of the bottle extends from the ring 502 upwardly and to the right of the ring 502 and a portion of the neck of the bottle extends from the ring 502 downwardly and to the left of the ring 502.

FIGS. 28A-G illustrate one instance of a bottle holder 500 that includes the same features as the bottle holder 500 described in FIGS. 26A-H; however, the bottle holder 500 in FIGS. 28A-G includes multiple extension members 503 and corresponding rings 502. In this particular instance, the bottle holder 500 includes three extension members 503 and three corresponding rings 502. Due to the same features, the reference numbers and the description for the bottle holder 500 in FIGS. 26A-H are also applicable to the bottle holder 500 in FIGS. 28A-G.

The bottle holder 500 includes a plate 501, three extension members 503 coupled to the plate 501 and extending outwards from the plate 501, and a ring 502 coupled to each extension member 503 (i.e., three rings 502) and configured to receive a portion of a bottle. The rings 502 illustrated in FIGS. 28A-G are in the same orientation with respect to a vertical axis as the rings 502 in FIGS. 26A-H. Thus, due to the orientation of the rings 502 in FIGS. 28A-G, the bodies of the bottles may extend from the rings 502 upwardly and to the left of the rings 502 with a portion of the necks of the bottles extending from the rings 502 downwardly and to the right of the rings 502.

Each extension member 503 may be spaced apart from the other extension member 503. Moreover, each extension member 503 may be substantially perpendicular to the plate 501.

In one instance, the bottle holder 500 may include two extension members 503 and corresponding rings 502, whereby each extension member 503 is coupled to the plate 501 and extends outwards from the plate 501 and each ring 502 is coupled to each extension member 503 and configured to receive a portion of a bottle. For example, the bottle holder 500 may include a plate 501, an extension member 503 (i.e., first extension member), an extension member 503 (i.e., second extension member) that is spaced apart from the first extension member 503, a ring 502 (i.e., first ring) coupled to the first extension member 503, and a ring 502 (i.e., second ring) coupled to the second extension member 503.

In another instance, the bottle holder 500 may include three extension members 503 and corresponding rings 502, whereby each extension member 503 is coupled to the plate 501 and extends outwards from the plate 501 and each ring 502 is coupled to each extension member 503 and configured to receive a portion of a bottle. For example, the bottle holder 500 may include a plate 501, an extension member 503 (i.e., first extension member), an extension member 503 (i.e., second extension member) that is spaced apart from the first extension member 503, an extension member 503 (i.e., third extension member) that is spaced apart from the first extension member 503 and the second extension member 503, a ring 502 (i.e., first ring) coupled to the first extension member 503, a ring 502 (i.e., second ring) coupled to the second extension member 503, and a ring 502 (i.e., third ring) coupled to the third extension member 503.

In other instances, the bottle holder 500 may include more than three extension members 503 and corresponding rings 502, whereby each extension member 503 is coupled to the plate 501 and extends outwards from the plate 501 and each ring 502 is coupled to each extension member 503 and configured to receive a portion of a bottle.

FIGS. 29A-G illustrate one instance of a bottle holder 500 that includes the same features as the bottle holder 500 described in FIGS. 26A-H; however, the bottle holder 500 of FIGS. 29A-G includes multiple extension members 503 and corresponding rings 502 and the bottle holder 500 also includes the ring 502 in a different orientation. Due to the same features, the reference numbers and the description for the bottle holder 500 in FIGS. 26A-H are also applicable to the bottle holder 500 in FIGS. 29A-G. Moreover, the reference numbers and the description for the bottle holder 500 in FIGS. 28A-G are also applicable to the bottle holder 500 in FIGS. 29A-G.

The bottle holder 500 includes a plate 501, three extension members 503 coupled to the plate 501 and extending outwards from the plate 501, and a ring 502 coupled to each extension member 503 (i.e., three rings 502) and configured to receive a portion of a bottle. However, the rings 502 illustrated in FIGS. 29A-G are mirror-imaged about a vertical axis (i.e., in the opposite orientation with respect to a vertical axis) from the ring 502 illustrated in FIGS. 26A-H. Thus, due to the orientation of the rings 502 in FIGS. 29A-G, the bodies of the bottles extend from the rings 502 upwardly and to the right of the rings 502 and a portion of the necks of the bottles extend from the rings 502 downwardly and to the left of the rings 502.

The bottle holder 500 may include two or more extension members 503 and corresponding rings 502, whereby each extension member 503 is coupled to the plate 501 and extends outwards from the plate 501 and each ring 502 is coupled to each extension member 503 and configured to receive a portion of a bottle.

FIGS. 30A-G illustrate one instance of a bottle holder 600 that includes the same features as the bottle holder 500 described in FIGS. 26A-H; however, the bottle holder 600 of FIGS. 30A-G includes a second ring 604 coupled to the first ring 602. Due to the same features, the reference numbers and the description for the bottle holder 500 in FIGS. 26A-H are also applicable to the bottle holder 600 in FIGS. 30A-G; however, the reference numbers in FIGS. 30A-G are 600 series rather than 500 series.

The bottle holder 600 includes a plate 601, an extension member 603 extending from the plate 601, a first ring 602 coupled to the extension member 603, and a second ring 604 coupled to the first ring 602. In one instance, the plate 601, the extension member 603, the first ring 602, and the second ring 604 may be unitarily constructed. In other instances, the bottle holder 600 may be constructed of more than one material.

In one instance, the first ring 602 illustrated in FIGS. 30A-G is mirror-imaged about a vertical axis (i.e., in the opposite orientation with respect to a vertical axis) from the ring 502 illustrated in FIGS. 26A-H and the second ring 604 illustrated in FIGS. 30A-G is in the same orientation with respect to a vertical axis as the ring 502 in FIGS. 26A-H. Thus, due to the orientation of the first ring 602 and second ring 604 in FIGS. 30A-G, the body of the first bottle may extend from the first ring 602 upwardly and to the right of the first ring 602 with a portion of the neck of the first bottle extending from the first ring 602 downwardly and to the left of the first ring 602. The body of the second bottle may extend from the second ring 604 upwardly and to the left of the second ring 604 with a portion of the neck of the second bottle extending from the second ring 604 downwardly and to the right of the second ring 604.

In other instances (not shown in FIGS. 30A-G), the first ring 602 is in the same orientation with respect to a vertical axis as the ring 502 in FIGS. 26A-H and the second ring 604 is mirror-imaged about a vertical axis (i.e., in the opposite orientation with respect to a vertical axis) from the ring 502 illustrated in FIGS. 26A-H. Thus, due to the orientation of the first ring 602 and second ring 604, the body of the first bottle may extend from the first ring 602 upwardly and to the left of the first ring 602 with a portion of the neck of the first bottle extending from the first ring 602 downwardly and to the right of the first ring 602. The body of the second bottle may extend from the second ring 604 upwardly and to the right of the second ring 604 with a portion of the neck of the second bottle extending from the second ring 604 downwardly and to the left of the second ring 604.

Continuing with FIGS. 30A-G, a second ring 604 may be coupled to the first ring 602. In one instance, the second ring 604 may be coupled to opposite side of the first ring 602 from the location where the extension member 603 is coupled to the first ring 602. In other words, the second ring 604 is coupled to the first ring 602 at a location approximately 180-degrees around the circumference of the first ring 602 from the location where the extension member 603 is coupled to the first ring 602. In other instances, the second ring 604 may be coupled to the first ring 602 at a location approximately 90-degrees or approximately 270-degrees around the circumference of the first ring 602 from the location where the extension member 603 is coupled to the first ring 602.

In another instance, an extension member (not shown in FIGS. 30A-G) may connect the first ring 602 to the second ring 604 rather than the second ring 604 being coupled directly to the first ring 602. In other words, the extension member (not shown in FIGS. 30A-G) may contain two ends, the first end coupled to the first ring 602 and the second end coupled to the second ring 604.

The second ring 604 may be configured to receive a portion of a second bottle. In other words, the bottle holder 600 supports the second bottle when the second ring 604 receives a portion of the second bottle. The bottle holder 600 may be used to support any bottle, such as a glass bottle or a plastic bottle. For example, the bottle holder 600 may hold beverage bottle. In some instances, the bottle holder 600 may hold a wine bottle, a beer bottle, or a liquor bottle.

The second ring 604 may be an oblique cylindrical body, wherein an oblique cylinder is different than a right cylinder. A right cylinder contains a circular first base, a circular second base that is parallel to the first base, and a cylindrical or curvate surface that connects the circular first base to the circular second base. Additionally, a segment that would connect the center of the first base to the center of the second base is perpendicular to the first base and the second base. Thus, the cylindrical surface connecting the circular first base to the circular second base is perpendicular to both the circular first base and the circular second base. Conversely, an oblique cylinder contains a first base, a second base that is parallel to the first base, and a curved or cylindrical surface that connects the first base to the second base. Additionally, a segment that would connect the center of the first base to the center of the second base is oblique (i.e., not perpendicular) to the first base and the second base. Thus, the curved surface connecting the first base to the second base is oblique to both the first base and the second base.

The oblique cylindrical body of the second ring 604 may have a first end surface 639 and a second end surface 641, wherein the second end surface 641 is opposite the first end surface 639. In one instance, when the bottle holder 600 is installed, the first end surface 639 may be the left side of the second ring 604 and the second end surface 641 may be the right side of the second ring 604. The second end surface 641 and the first end surface 639 may be parallel to each other. The first end surface 639 may be oblique (i.e., not perpendicular) to the oblique cylindrical body and, as a result, the first end surface 639 may be oval shaped. The first end surface 639 may define an oblique opening, which may be oval shaped. Similarly, the second end surface 641 may be oblique with respect to the oblique cylindrical body and, as a result, the second end surface 641 may be oval shaped. The second end surface 641 may define an oblique opening, which may be oval shaped.

The oblique cylindrical body of the second ring 604 may include an outer cylindrical surface 643 and/or an inner cylindrical surface 645. The first end surface 639 may be oblique (i.e., not perpendicular) with respect to the outer cylindrical surface 643 and/or inner cylindrical surface 645. Additionally, the second end surface 641 may be oblique with respect to the outer cylindrical surface 643 and/or inner cylindrical surface 645. The inner cylindrical surface 645 may be configured to receive the neck of a second bottle.

The oblique cylindrical body of the second ring 604 may include a centerline that is coaxial with the inner cylindrical surface 645. The oblique cylindrical body of the second ring 604 may be oriented so that the centerline forms a vertically offset angle between 15-degrees and 75-degrees with respect to a vertical axis when the plate 601 is mounted to a surface. For example, in one instance, the oblique cylindrical body may be oriented so that the centerline forms a vertically offset angle of about 45-degrees with respect to the vertical axis. For example, in one instance, the oblique cylindrical body may be oriented so that the centerline forms a vertically offset angle of about 67-degrees with respect to the vertical axis (about 23-degrees with respect to a horizontal axis). For example, in one instance, the oblique cylindrical body may be oriented so that the centerline forms a vertically offset angle of about 60-degrees with respect to the vertical axis (about 30-degrees with respect to a horizontal axis). For example, in one instance, the oblique cylindrical body may be oriented so that the centerline forms a vertically offset angle of about 30-degrees with respect to the vertical axis (about 60-degrees with respect to a horizontal axis).

The longitudinal axis of the bottle may be oriented at a slightly different angle than the centerline CL of the oblique cylindrical body of the second ring 604. In one instance, the longitudinal axis of the bottle may be angled slightly less with respect to a horizontal axis (slightly greater with respect to the vertical axis) than the centerline of the oblique cylindrical body of the second ring 604 because gravity will cause the bottle to rotate around the second ring 604. Thus, if a certain angle of the bottle is desired, then a slightly different angle must be provided for the centerline of the second ring 604 to account for the bottle tending to rotate about the second ring 604. In one instance, the oblique cylindrical body of the second ring 604 may be configured to hold a bottle at an angle of about 23-degrees with respect to a horizontal axis (about 67-degrees with respect to the vertical axis). In another instance, the oblique cylindrical body of the second ring 604 may be configured to hold a bottle at an angle of about 30-degrees with respect to a horizontal axis (about 60-degrees with respect to the vertical axis).

The first and second end surfaces 639, 641 are parallel to each other. The first and second end surfaces 639, 641 are, however, not perpendicular to the inner cylindrical surface 645 since the second ring 604 is not a right cylinder. Because the second ring 604 is an oblique cylindrical body, a plane defined by the first and/or second end surface 639, 641 has a normal line (centered on the oblique opening) that is not coincident with the centerline (which is coaxial with the inner cylindrical surface 645). An offset angle is defined between the centerline and the normal line. In one instance, the offset angle OA is about 15 degrees. In one instance, the offset angle OA is about 10 degrees. In one instance, the offset angle OA is about 5 degrees. In one instance, the offset angle is about 20 degrees. In one instance, the offset angle is about 25 degrees. In a right cylinder, the centerline would be coincident with the normal line. By using an oblique cylindrical body for the second ring 604, less material is used in the manufacture of the second ring 604 as compared with a ring that is a right cylinder. The oblique cylindrical body functions to support the bottle as efficiently as a right cylinder, but it uses less material to do so. The oblique cylindrical body supports the bottle in the needed positions to counteract the bending moment of the bottle within the second ring 604 (i.e., downward force on the lower portion of the second ring 604, and an upward force on the upper portion of the second ring 604). In one instance, the centerline may be parallel to the plate 601.

In one instance, the oblique cylindrical body of the second ring 604 may have the opposite orientation with respect to vertical from the first ring 602. In other words, the second ring 604 is mirror-imaged about a vertical axis (i.e., in the opposite orientation with respect to a vertical axis) from the first ring 602. Thus, the first bottle in the first ring 602 is oriented in an opposing direction from the second bottle in the second ring 604.

In one instance, the second ring 604 may be configured to receive the neck of the second bottle. For example, the second ring 604 may be configured to receive the neck of a second wine bottle. In one instance, the second ring 604 may be configured to receive the second wine bottle angled in a cork-down orientation. In one instance, the neck of a second bottle may be inserted through the second ring 604 with the bottle angled downward. The second ring 604 may be configured to support the neck of the second bottle with the second bottle angled downward. This orientation may allow liquid within the second bottle to contact the cap, cork, or otherwise seal at or near the mouth of the second bottle. For example, the downward orientation of a wine bottle (i.e., cork down orientation) may allow liquid wine within the second bottle to contact the cork of the wine bottle. This may keep the cork moist, thereby preventing the cork from drying out and preventing the ingress of air into the wine bottle.

A portion of the neck of the second bottle may contact a portion of the inner cylindrical surface 645 of the second ring 604. For example, an upward-facing portion of the inner cylindrical surface 645 may contact a downward-facing portion of the neck and a downward-facing portion of the inner cylindrical surface 645 may contact an upward-facing portion of the neck. Thus, the inner cylindrical surface 645 constrains the neck of the second bottle, thereby supporting the second bottle. When the portions of the inner cylindrical surface 645 are engaged with the neck of the second bottle, the forces applied by the inner cylindrical surface 645 prevent the second bottle from translating horizontally or vertically and also prevent rotation of the second bottle.

The oblique cylindrical body of the second ring 604 may provide advantages over a right cylindrical body. For example, an oblique cylindrical body may provide more surface area for the second bottle to contact (i.e., contact area). The oblique cylindrical body contains an inner cylindrical surface 645 that is not perpendicular to either the first end surface 639 or the second end surface 641. As a result, the second bottle may be supported by the oblique cylindrical body at two edges (i.e., the first edge is formed by the intersection of the inner cylindrical surface 645 with the first end surface 639 and the second edge is formed by the intersection of the inner cylindrical surface 645 with the second end surface 641) and/or by the inner cylindrical surface 645. In other words, the second bottle may contact a greater portion of the inner cylindrical surface 645 of the oblique cylindrical body because the inner cylindrical surface 645 is not perpendicular to the bases. This greater contact area may reduce stress concentrations where the oblique cylindrical body supports the bottle. Thus, the oblique cylindrical body may provide a safer way to support a second bottle.

On the other hand, a right cylindrical body may provide less surface area for a second bottle to contact (i.e., contact area). A right cylindrical body would contain an inner cylindrical surface that would be perpendicular to both the first end surface and the second end surface. As a result, the bottle may be supported by the right cylindrical body only at two edges; the first edge is formed by the intersection of the inner cylindrical surface with the first end surface and the second edge is formed by the intersection of the inner cylindrical surface with the second end surface. This lesser contact area might increase stress concentrations where the right cylindrical body supports the second bottle.

FIGS. 31A-G illustrate one instance of a bottle holder 600 that includes the same features as the bottle holder 600 described in FIGS. 30A-G; however, the bottle holder 600 of FIGS. 31A-G includes multiple extension members 603 and corresponding first rings 602 and second rings 604. In this particular instance, the bottle holder 600 includes three extension members 603, three corresponding first rings 602, and three corresponding second rings 604. Due to the same features, the reference numbers and the description for the bottle holder 600 in FIGS. 30A-G are also applicable to the bottle holder 600 in FIGS. 31A-G.

The bottle holder 600 includes plate 601, three extension members 603 coupled to the plate 601 and extending outwards from the plate 601, a first ring 602 coupled to each extension member 603 (i.e., three first rings 602) and configured to receive a portion of a first bottle, and a second ring 604 coupled to each first ring 602 (i.e., three second rings 604) and configured to receive a portion of a second bottle.

In one instance, the first ring 602 and the second ring 604 illustrated in FIGS. 31A-G are in the same orientation with respect to a vertical axis as the first ring 602 and the second ring 604 illustrated in FIGS. 30A-G. Thus, due to the orientation of the first ring 602 and second ring 604 in FIGS. 31A-G, the body of the first bottle may extend from the first ring 602 upwardly and to the right of the first ring 602 with a portion of the neck of the first bottle extending from the first ring 602 downwardly and to the left of the first ring 602. The body of the second bottle may extend from the second ring 604 upwardly and to the left of the second ring 604 with a portion of the neck of the second bottle extending from the second ring 604 downwardly and to the right of the second ring 604.

In other instances, the first ring 602 and the second ring 604 illustrated in FIGS. 31A-G are mirror-imaged about a vertical axis (i.e., in the opposite orientation with respect to a vertical axis) from the first ring 602 and the second ring 604 illustrated in FIGS. 30A-G. Thus, due to the orientation of the first ring 602 and second ring 604 in FIGS. 31A-G, the body of the first bottle may extend from the first ring 602 upwardly and to the left of the first ring 602 with a portion of the neck of the first bottle extending from the first ring 602 downwardly and to the right of the first ring 602. The body of the second bottle may extend from the second ring 604 upwardly and to the right of the second ring 604 with a portion of the neck of the second bottle extending from the second ring 604 downwardly and to the left of the second ring 604.

In one instance, the bottle holder 600 may include two extension members 603 and corresponding first rings 602 and second rings 604. In this instance, each extension member 603 is coupled to the plate 601 and extends outwards from the plate 601, each first ring 602 is coupled to each extension member 603 and configured to receive a portion of a first bottle, and each second ring 604 is coupled to each first ring 602 and configured to receive a portion of a second bottle. For example, the bottle holder 600 may include a plate 601, an extension member 603 (i.e., first extension member), an extension member 603 (i.e., second extension member) that is spaced apart from the first extension member 603, a first ring 602 (i.e., first ring) coupled to the first extension member 603, a first ring 602 (i.e., second ring) coupled to the second extension member 603, a second ring 604 (i.e., third ring) coupled to the first ring 602 (i.e., first ring), and a second ring 604 (i.e., fourth ring) coupled to the first ring 602 (i.e., second ring). In one instance, the second ring 604 (i.e., third ring) may be positioned a distance away from the plate 601 and the second ring 604 (i.e., fourth ring) may be positioned the same distance away from the plate 601.

In another instance, the bottle holder 600 may include three extension members 603 and corresponding first rings 602 and second rings 604. In this instance, each extension member 603 is coupled to the plate 601 and extends outwards from the plate 601, each first ring 602 is coupled to each extension member 603 and configured to receive a portion of a first bottle, and each second ring 604 is coupled to each first ring 602 and configured to receive a portion of a second bottle. For example, the bottle holder 600 may include a plate 601, an extension member 603 (i.e., first extension member), an extension member 603 (i.e., second extension member) that is spaced apart from the first extension member 603, an extension member 603 (i.e., third extension member) that is spaced apart from the first extension member 603 and the second extension member 603, a first ring 602 (i.e., first ring) coupled to the first extension member 603, a first ring 602 (i.e., second ring) coupled to the second extension member 603, and a first ring 602 (i.e., third ring) coupled to the third extension member 603, a second ring 604 (i.e., fourth ring) coupled to the first ring 602 (i.e., first ring), a second ring 604 (i.e., fifth ring) coupled to the first ring 602 (i.e., second ring), and a second ring 604 (i.e., sixth ring) coupled to the first ring 602 (i.e., third ring).

In other instances, the bottle holder 600 may include more than three extension members 603 and corresponding first rings 602 and second rings 604, whereby each extension member 603 is coupled to the plate 601 and extends outwards from the plate 601, each first ring 602 is coupled to each extension member 603 and configured to receive a portion of a first bottle, and each second ring 604 is coupled to each first ring 602 and configured to receive a portion of a second bottle.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. From the above description and drawings, it will be understood by those of ordinary skill in the art that the particular embodiments shown and described are for purposes of illustrations only and are not intended to limit the scope of the present invention. References to details of particular embodiments are not intended to limit the scope of the invention.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A wine bottle holder comprising:

a plate configured to be mounted to a surface;

an extension member coupled to the plate and extending outwards therefrom;

a first ring coupled to the extension member and configured to receive a portion of a first wine bottle therethrough, the first ring comprising a first oblique cylindrical body having a first pair of opposite end surfaces that are parallel to each other, the first pair of opposite end surfaces defining first oblique openings; and a second ring coupled to the first ring and configured to receive a portion of a second wine bottle therethrough, the second ring comprising a second oblique cylindrical body having a second pair of opposite end surfaces that are parallel to each other, the second pair of opposite end surfaces defining second oblique openings, wherein the second oblique cylindrical body includes an inner cylindrical surface and a second centerline that is coaxial with the inner cylindrical surface, the second oblique cylindrical body oriented so that the second centerline forms an angle between 15-degrees and 75-degrees with respect to a vertical axis when the plate is mounted to the surface, the second ring in an opposite orientation with respect to the vertical axis from the first ring so as to orient the first and second wine bottles in an opposing orientation.

2. The wine bottle holder of claim 1, wherein the first oblique cylindrical body includes a first outer cylindrical surface and a first inner cylindrical surface.

3. The wine bottle holder of claim 1, wherein the first oblique cylindrical body includes a first inner cylindrical surface and a first centerline that is coaxial with the first inner cylindrical surface, the first oblique cylindrical body oriented so that the first centerline forms an angle between 15-degrees and 75-degrees with respect to the vertical axis when the plate is mounted to the surface.

4. The wine bottle holder of claim 3, wherein the first inner cylindrical surface of the first ring is configured to receive a neck of the first wine bottle, the first wine bottle angled in a cork-down orientation.

5. The wine bottle holder of claim 1, wherein the extension member is substantially perpendicular to the plate.

6. The wine bottle holder of claim 1, wherein the plate includes at least one through hole configured to receive a fastener to mount the plate to the surface.

7. The wine bottle holder of claim 1, wherein the plate, the extension member, and the first ring are unitarily constructed.

8. The wine bottle holder of claim 1, wherein the first oblique cylindrical body includes a first inner cylindrical surface and a first centerline that is coaxial with the first inner cylindrical surface, wherein one of the first pair of opposite end surfaces of the first oblique cylindrical body lies in a plane having a normal line centered on one of the first oblique openings, the first centerline not being coincident with the normal line.

9. The wine bottle holder of claim 1, wherein the plate is configured to be mounted in a first configuration and a second configuration by rotating the plate one hundred eighty degrees on the surface, wherein, in both of the first configuration and the second configuration, a wine bottle is configured to be supported in a same angular orientation relative to the vertical axis.

10. A wine bottle holder comprising:

a plate configured to be mounted to a surface;

a first extension member coupled to the plate and extending outwards therefrom;

a first ring coupled to the first extension member and configured to receive a portion of a first wine bottle therethrough, the first ring comprising a first oblique cylindrical body having a first pair of opposite end surfaces that are parallel to each other, the first pair of opposite end surfaces defining first oblique openings;

a second extension member coupled to the plate and extending outwards therefrom, the second extension member spaced apart from the first extension member; and a second ring coupled to the second extension member and configured to receive a portion of a second wine bottle therethrough, the second ring comprising a second oblique cylindrical body having a second pair of opposite end surfaces that are parallel to each other, the second pair of opposite end surfaces defining second oblique openings, wherein the first oblique cylindrical body includes a first outer cylindrical surface and a first inner cylindrical surface, wherein the second oblique cylindrical body includes a second outer cylindrical surface and a second inner cylindrical surface, and wherein the first oblique cylindrical body defines a first centerline that is coaxial with the first inner cylindrical surface, and wherein the second oblique cylindrical body defines a second centerline that is coaxial with the second inner cylindrical surface, the first oblique cylindrical body oriented so that the first centerline forms an angle between 15-degrees and 75-degrees with respect to a vertical axis when the plate is mounted to the surface, the second oblique cylindrical body oriented so that the second centerline forms an angle between 15-degrees and 75-degrees with respect to the vertical axis when the plate is mounted to the surface.

11. The wine bottle holder of claim 10, wherein the first inner cylindrical surface of the first ring is configured to receive a neck of the first wine bottle, the first wine bottle angled in a cork-down orientation, wherein the second inner cylindrical surface of the second ring is configured to receive the neck of the second wine bottle, the second wine bottle angled in a cork-down orientation.

12. The wine bottle holder of claim 10, wherein the first extension member is substantially perpendicular to the plate, wherein the second extension member is substantially perpendicular to the plate.

13. The wine bottle holder of claim 10, wherein the plate includes at least one through hole configured to receive a fastener to mount the plate to the surface.

14. The wine bottle holder of claim 10, wherein the plate, the first extension member, the first ring, the second extension member, and the second ring are unitarily constructed.

15. The wine bottle holder of claim 10, further comprising a third ring and a fourth ring, the third ring coupled to the first ring and configured to receive a portion of a third wine bottle therethrough, the third ring comprising a third oblique cylindrical body having a third pair of opposite end surfaces that are parallel to each other, the third pair of opposite end surfaces defining third oblique openings, the fourth ring coupled to the second ring and configured to receive a portion of a fourth wine bottle therethrough, the fourth ring comprising a fourth oblique cylindrical body having a fourth pair of opposite end surfaces that are parallel to each other, the fourth pair of opposite end surfaces defining fourth oblique openings.

16. The wine bottle holder of claim 15, wherein the third ring is positioned a distance away from the plate, the fourth ring positioned the distance away from the plate.

17. The wine bottle holder of claim 10, wherein the first centerline of the first oblique cylindrical body is substantially parallel to the second centerline of the second oblique cylindrical body.

18. The wine bottle holder of claim 10, wherein the first centerline of the first oblique cylindrical body is not substantially parallel to the second centerline of the second oblique cylindrical body.

19. The wine bottle holder of claim 10, wherein one of the first pair of opposite end surfaces of the first oblique cylindrical body lies in a plane having a normal line centered on one of the first oblique openings, the first centerline not being coincident with the normal line.

20. The wine bottle holder of claim 10, wherein the plate is configured to be mounted in a first configuration and a second configuration by rotating the plate one hundred eighty degrees on the surface, wherein, in both of the first configuration and the second configuration, a wine bottle is configured to be supported in a same angular orientation relative to the vertical axis.

* * * * *